US009204764B1

(12) United States Patent
Hanley

(10) Patent No.: US 9,204,764 B1
(45) Date of Patent: Dec. 8, 2015

(54) CURVED SHOWER ROD WITH OBLONG BRACKETS AND CENTER SCREW

(71) Applicant: Kenney Manufacturing Company, Warwick, RI (US)

(72) Inventor: Michael Hanley, Smithfield, RI (US)

( * ) Notice: Subject to any disclaimer, the term of this patent is extended or adjusted under 35 U.S.C. 154(b) by 410 days.

(21) Appl. No.: 13/667,844

(22) Filed: Nov. 2, 2012

Related U.S. Application Data

(60) Provisional application No. 61/554,735, filed on Nov. 2, 2011.

(51) Int. Cl.
*A47K 3/00* (2006.01)
*A47K 3/38* (2006.01)

(52) U.S. Cl.
CPC .... *A47K 3/38* (2013.01); *A47K 3/00* (2013.01)

(58) Field of Classification Search
CPC ..... A47K 3/284
USPC ..... 4/614, 596–613
See application file for complete search history.

(56) References Cited

U.S. PATENT DOCUMENTS 4,461,056 A * 7/1984 Solinski ..... 16/87.4 R
4,754,504 A * 7/1988 Cellini ..... 4/610
4,769,862 A * 9/1988 Skrzelowski ..... 4/610
5,101,522 A * 4/1992 Prian ..... 4/610
5,371,908 A * 12/1994 Secondine ..... 4/609
5,426,821 A * 6/1995 Story ..... 16/87.4 R
5,513,419 A * 5/1996 Zinger ..... 16/87.4 R
6,216,287 B1 * 4/2001 Wise ..... 4/610
7,065,806 B2 * 6/2006 Reichel et al. ..... 4/607
7,219,376 B1 * 5/2007 Zhou ..... 4/567
7,222,376 B1 * 5/2007 Gunning ..... 4/610
7,512,997 B2 * 4/2009 Dewees ..... 4/610
7,926,127 B2 * 4/2011 Barrese ..... 4/610
8,051,781 B1 * 11/2011 Vind et al. ..... 108/42
8,146,182 B2 4/2012 Bauer
8,214,938 B2 * 7/2012 Hanley et al. ..... 4/610
2005/0268394 A1 * 12/2005 Monk et al. ..... 4/558
2006/0096023 A1 * 5/2006 Dewees ..... 4/558
2007/0006377 A1 * 1/2007 Moore ..... 4/558
2007/0006378 A1 * 1/2007 Moore ..... 4/558
2007/0093736 A1 * 4/2007 Hebert ..... 601/137
2008/0022451 A1 * 1/2008 Urlich et al. ..... 4/610
2008/0028513 A1 * 2/2008 Didehvar ..... 4/610
2008/0115265 A1 * 5/2008 Heaslip ..... 4/610
2008/0184479 A1 * 8/2008 Bathurst ..... 4/610
2008/0185353 A1 * 8/2008 Immerman et al. ..... 211/16
2008/0244826 A1 * 10/2008 Grohe ..... 4/695
2008/0282464 A1 * 11/2008 Bauer ..... 4/610
2008/0289095 A1 * 11/2008 Li ..... 4/610
2008/0295240 A1 * 12/2008 Chang ..... 4/610

(Continued)

*Primary Examiner* — Lori Baker
(74) *Attorney, Agent, or Firm* — Steven M McHugh

(57) ABSTRACT

A curved shower rod assembly is provided and includes a first end rod and a second end rod, wherein each of the first end rod and second end rod include a rod bracket end and a rod interface end, the rod bracket end and rod interface end being separated by a rod curved portion. A center rod is also included, wherein the center rod is hollow and includes a center rod inner diameter sized to movably contain the rod interface ends. Additionally, a screw rod having a first end with right-hand threads and a second end with left-hand threads is also provided, wherein the screw rod is securely contained within the center rod. A first mounting bracket and a second mounting bracket are also included, wherein each of the first and second mounting brackets are oblong in shape and include a bracket top and a bracket bottom.

19 Claims, 32 Drawing Sheets

(56) References Cited

U.S. PATENT DOCUMENTS

| | | | | |
|---|---|---|---|---|
| 2009/0083905 | A1* | 4/2009 | O'Connell | 4/608 |
| 2009/0119830 | A1* | 5/2009 | Goskowski et al. | 4/610 |
| 2009/0193575 | A1* | 8/2009 | Prian | 4/558 |
| 2009/0300838 | A1* | 12/2009 | Didehvar | 4/610 |
| 2010/0031438 | A1* | 2/2010 | Boonstra | 4/607 |
| 2010/0186161 | A1* | 7/2010 | Wong | 4/610 |
| 2011/0031198 | A1* | 2/2011 | Trettin et al. | 211/123 |
| 2011/0035874 | A1* | 2/2011 | St. Jean | 4/610 |
| 2011/0047693 | A1* | 3/2011 | Bauer et al. | 4/609 |
| 2011/0094686 | A1* | 4/2011 | Kee et al. | 160/102 |
| 2011/0113547 | A1* | 5/2011 | O'Connell | 4/608 |
| 2011/0247133 | A1* | 10/2011 | Manga et al. | 4/610 |
| 2012/0074085 | A1* | 3/2012 | Chang | 211/105.3 |
| 2012/0110729 | A1* | 5/2012 | Baines | 4/610 |
| 2012/0167368 | A1* | 7/2012 | Napier et al. | 29/428 |
| 2012/0291243 | A1* | 11/2012 | Baines | 24/716 |
| 2013/0074255 | A1* | 3/2013 | Uncles | 4/601 |
| 2013/0198948 | A1* | 8/2013 | Zeng | 4/610 |
| 2013/0198949 | A1* | 8/2013 | Hai | 4/610 |
| 2013/0269099 | A1* | 10/2013 | Chang | 4/610 |
| 2013/0292349 | A1* | 11/2013 | Bucklew et al. | 211/105.2 |
| 2014/0130331 | A1* | 5/2014 | Didehvar et al. | 29/434 |
| 2014/0131298 | A1* | 5/2014 | Didehvar et al. | 211/105.2 |
| 2014/0131299 | A1* | 5/2014 | Didehvar et al. | 211/105.2 |

* cited by examiner

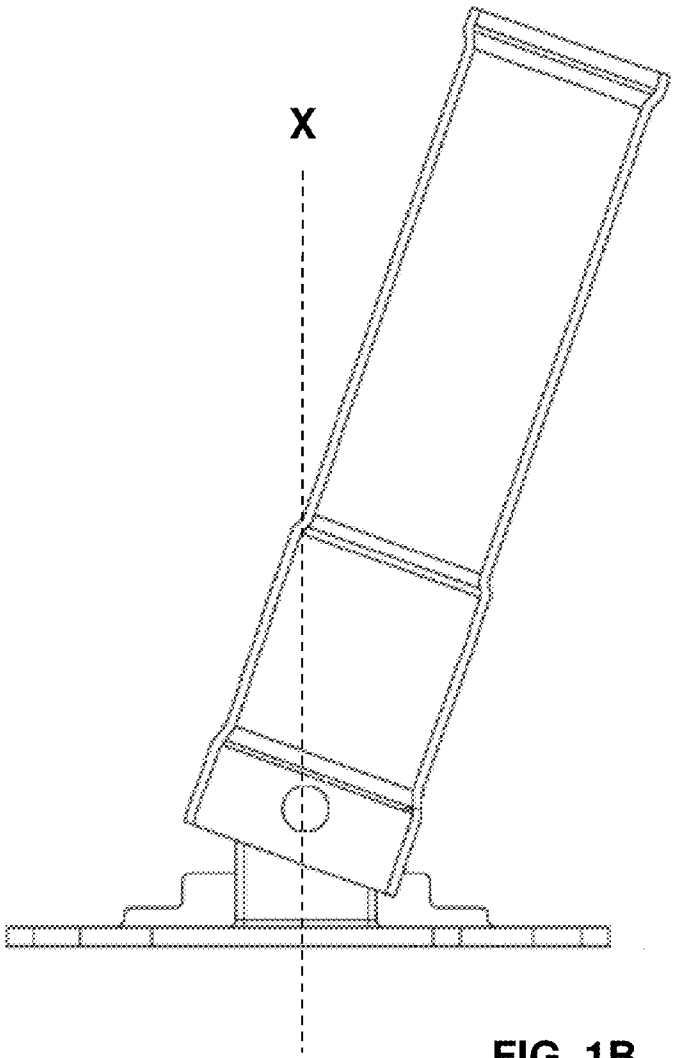
FIG. 1B
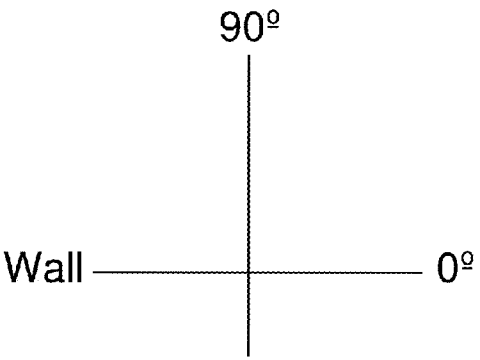
Prior Art

Section C-C

Section B-B

Section D-D

CURVED SHOWER ROD WITH OBLONG BRACKETS AND CENTER SCREW

RELATED APPLICATIONS

This application claims benefit of priority of the filing date of U.S. Provisional Patent Application Ser. No. 61/554,735 filed Nov. 2, 2011, the contents of which are incorporated by reference herein in its entirety.

FIELD OF THE INVENTION

This invention relates generally to shower rods and more particularly to a curved shower rod having a bracket which supports a torsional (rotational) load.

BACKGROUND OF THE INVENTION

Curved shower rods are well known in the art and are used to create more space within the shower enclosure than is generally available with a straight rod by angling the upper portion of the shower curtain away from the shower enclosure to give the user more upper body space. Referring to FIG. 1A, FIG. 1B and FIG. 1C, these curved rod systems are typically attached to the shower wall at an angle of less than 90° (between the rod and wall surface) and have an offset center section that is curved or bowed outward from the shower enclosure to provide the added upper body space while the bottom of the shower curtain remains within the bath tub.

Unfortunately, current designs have undesirable characteristics. This is because when a shower curtain is supported by the curved rod system, the combination of the weight of the shower curtain and the offset configuration creates a torsional downward force $F_D$ on the rod system. This force is exacerbated when a user pulls on the curtain, for example, when opening and closing the curtain, subjecting the rod to additional torsional forces. As a result, the rod 'wants' to rotate in the direction of the torsional force $F_D$ (downwardly toward the floor) about an axis X that is substantially perpendicular to the wall at the point where the curved rod system is connected to and supported by the wall. Accordingly, not only is there a torsional stress on the connection point between the curved rod system and the supporting wall, but there is a downward stress on the on the connection point between the curved rod system and the supporting wall caused by the weight of the curved rod system and shower curtain.

Furthermore, due to the configuration of the curved rod, the torsional and weight (downward) stresses are constantly present at the connection points between the curved rod system and the supporting wall. This is because no matter where on the curved shower rod the shower curtain is located, the weight of the shower curtain will generate a torsional load on the connectors. Accordingly, the connectors used to mount current curved shower bars must be strongly anchored to the shower wall to adequately counter these torsional and downward forces.

This characteristic requires that current curved shower rods be strongly affixed to the shower walls using screws or other physical mounting means. This is undesirable for several reasons. Firstly, tools and other hardware (such as screws) are required to install these rods. Secondly, if the rods are ever removed or replaced, multiple mounting holes are present in the walls and are unsightly unless they are repaired. And thirdly, because a large number of tub/shower combinations have tiled walls (or are constructed using plastic inserts), current curved shower rods systems cannot be used.

SUMMARY OF THE INVENTION

A curved shower rod assembly is provided and includes a first end rod and a second end rod, wherein each of the first end rod and second end rod include a rod bracket end and a rod interface end, the rod bracket end and rod interface end being separated by a rod curved portion and wherein the rod interface end is hollow. A center rod is also included, wherein the center rod is hollow and includes a center rod inner diameter sized to movably contain the rod interface ends. Additionally, a screw rod having a first end with right-hand threads and a second end with left-hand threads is also provided, wherein the screw rod is securely contained within the center rod. A first threaded sleeve and a second threaded sleeve are included, wherein the first and second threaded sleeves include bi-directional internal threads, wherein the first threaded sleeve is located within the rod interface end of the first end rod and the second threaded sleeve is located within the rod interface end of the second end rod, and wherein the rod interface end of the first end rod is located within the center rod such that the first threaded sleeve is proximate the first end of the screw rod, and the rod interface end of the second end rod is located within the center rod such that the second threaded sleeve is proximate the second end of the screw rod. Furthermore, a first mounting bracket and a second mounting bracket are included, wherein each of the first and second mounting brackets are oblong in shape and include a bracket top and a bracket bottom. The bracket top defines a socket cavity configured to contain the rod bracket end of the first and second end rod, and the bracket bottom includes a plurality of footpads.

A curved shower rod is provided and includes a first end rod and a second end rod, wherein each of the first end rod and second end rod include a rod bracket end and a rod interface end, the rod bracket end and rod interface end being separated by a rod curved portion and wherein the rod interface end is hollow. Additionally, a center rod is included, wherein the center rod is hollow and includes a center rod inner diameter sized to movably contain the rod interface ends. Furthermore, a screw rod having a first end with right-hand threads and a second end with left-hand threads is included, wherein the screw rod is securely contained within the center rod. Moreover, a first threaded sleeve and a second threaded sleeve are included, wherein the first and second threaded sleeves include bi-directional internal threads, wherein the first threaded sleeve is located within the rod interface end of the first end rod and the second threaded sleeve is located within the rod interface end of the second end rod, and wherein the rod interface end of the first end rod is located within the center rod such that the first threaded sleeve and the first end of the screw rod are threadingly associated and the rod interface end of the second end rod is located within the center rod such that the second threaded sleeve and the second end of the screw rod are threadingly associated.

A mounting bracket for mounting a curved shower rod within a shower enclosure between a pair of shower walls is provided, wherein the curved shower rod mounting bracket includes a first mounting bracket, and a second mounting bracket. The first mounting bracket and second mounting bracket are oblong in shape and includes a bracket front, a bracket rear, a bracket top and a bracket bottom, the bracket top defining a socket cavity and the bracket bottom including a first footpad and a second footpad, wherein the socket cavity is located proximate the bracket front and configured to contain the rod bracket end of the first and second end rod, and wherein the first footpad is located proximate the bracket front and the second footpad is located proximate the bracket rear.

BRIEF DESCRIPTION OF THE DRAWINGS

The foregoing and other features and advantages of the present invention should be more fully understood from the accompanying detailed description of illustrative embodiments taken in conjunction with the following Figures in which like elements are numbered alike in the several Figures:

FIG. 1B is a top down view showing the connection of the curved shower rod of FIG. 1A to the shower wall, in accordance with the prior art.

DETAILED DESCRIPTION

In accordance with the present invention, a curved shower rod which with brackets is provided where the rod includes new and novel features that allow for easy and ready installation and operation without the need to put holes in the supporting shower walls and without the use of tools or other hardware, such as screws and screw drivers. Additionally, the curved shower rod of the present invention includes new and novel features that provide the rod with the capability of supporting a load of approximately one pound per lineal foot of shower rod (or more) without twisting in space due to torsional forces exerted by the weight of the rod, the shower curtain and/or the opening/closing of the shower curtain during use. These new and novel features are described hereinafter with reference to the best mode and several other embodiments.

It should be appreciated that the curved shower rod of the present invention may be configured in multiple adjustable lengths, such as 5 foot or 6 foot. As described further herein, one way the advantages of the present invention may be achieved is by having multiple rod ends that are movably adjustable relative to a center rod piece to cause the ends to compress the rod brackets against the supporting shower wall, where each side of the curved shower rod may include only one bracket for a more aesthetically pleasing appearance. Another advantage of the curved shower rod of the present invention is that because there are more than two rod pieces, the disassembled curved shower rod can be packaged and stored in a smaller package than current curved shower rods.

Figure 1A:
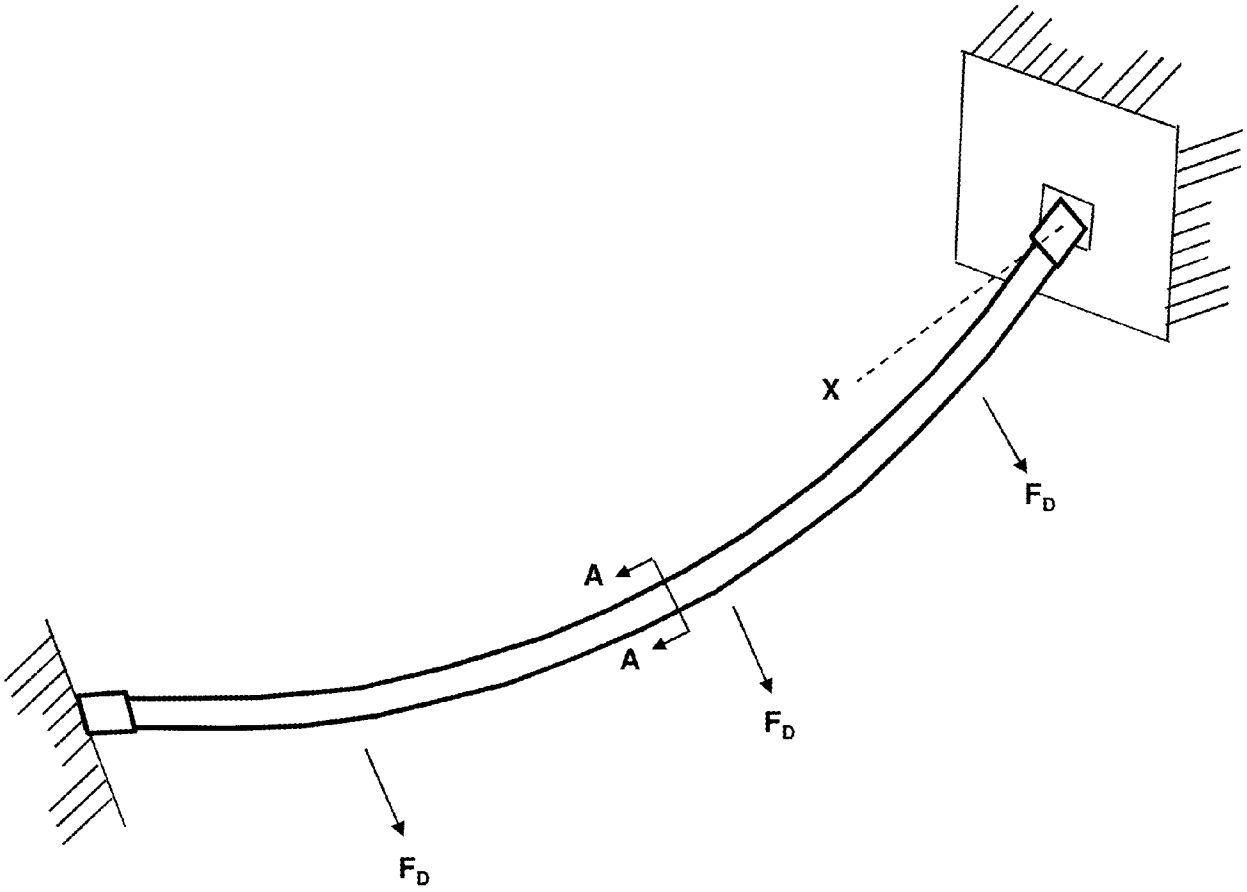
FIG. 1A Prior Art
FIG. 1A is a top down perspective view of a curved shower rod connected to shower walls, in accordance with prior art.
Figure 1C:
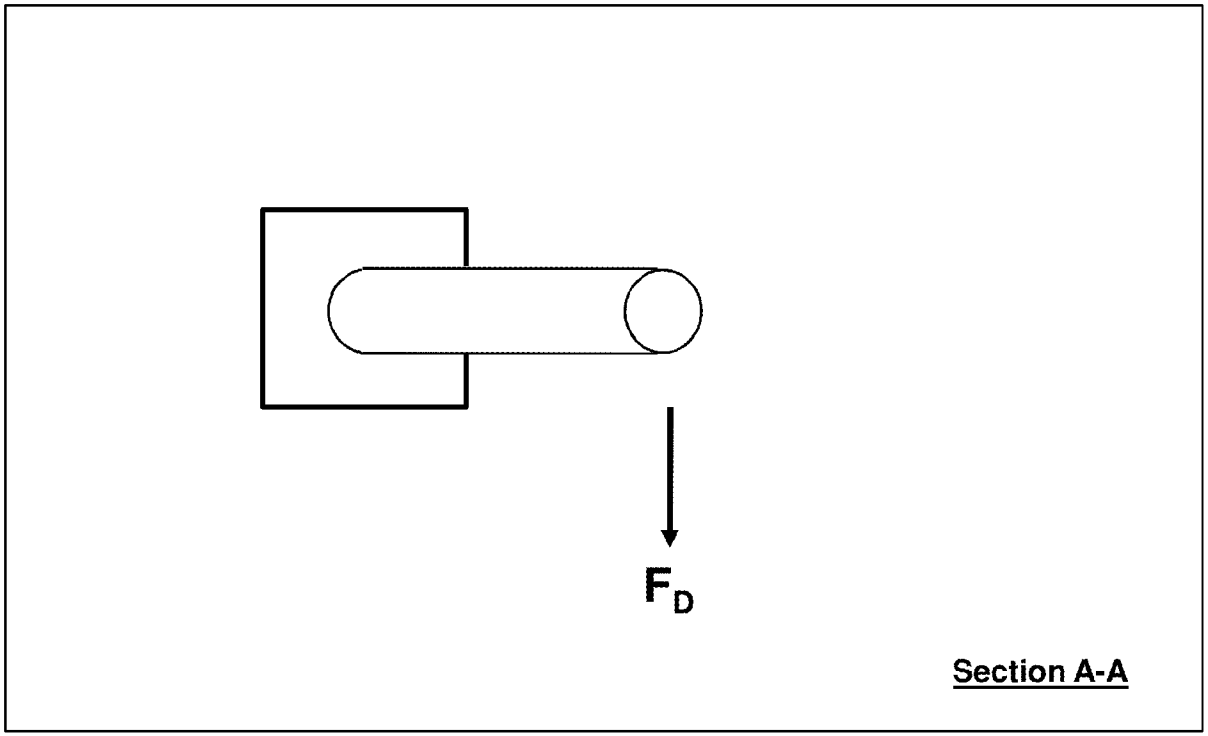
FIG. 1C Prior Art
FIG. 1C is a side sectional view of the curved shower rod of FIG. 1A, in accordance with the prior art.
Figure 2A:
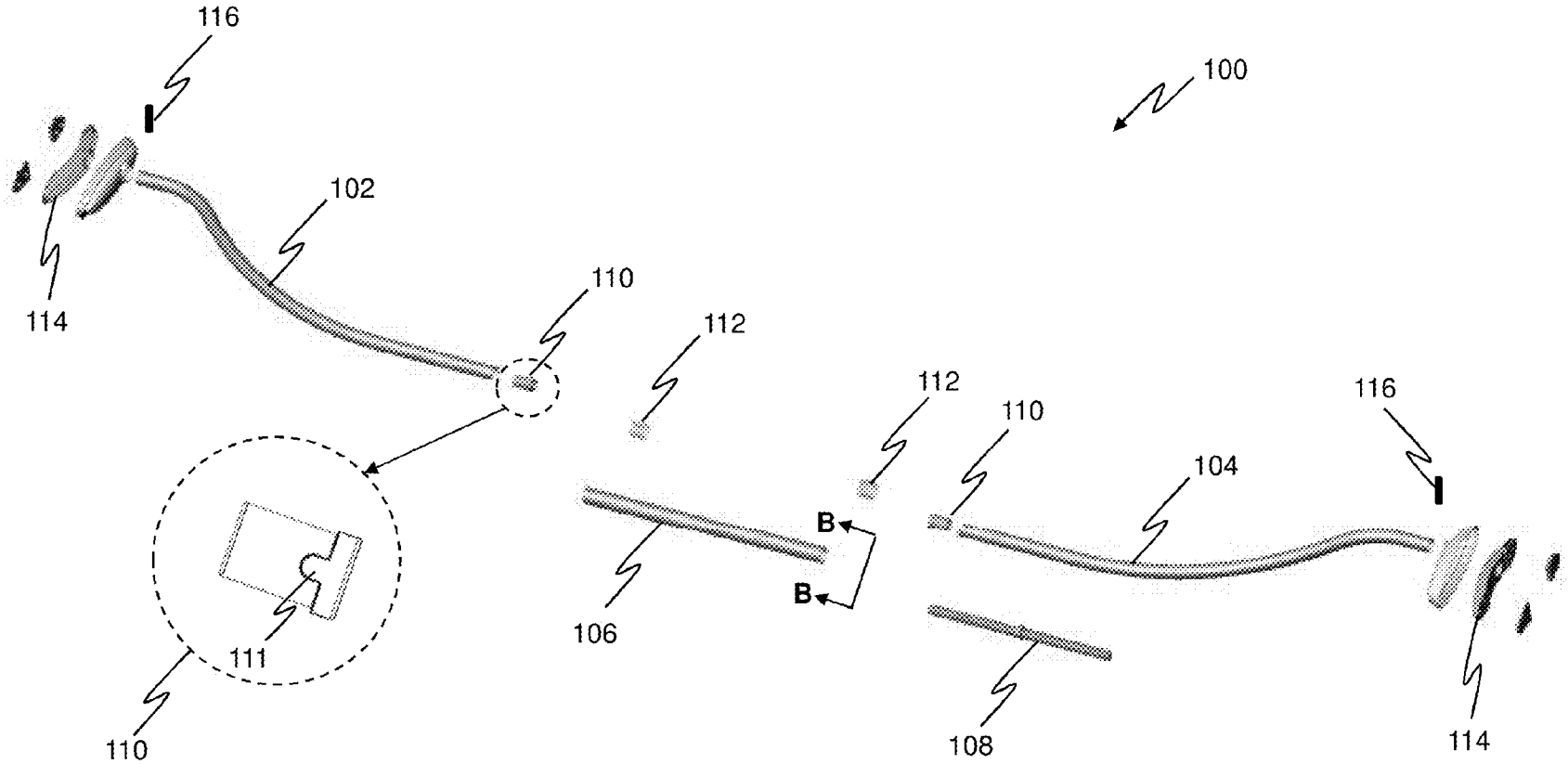
FIG. 2A is top down perspective view of a curved shower rod assembly, in accordance with the present invention.
Figure 2B:
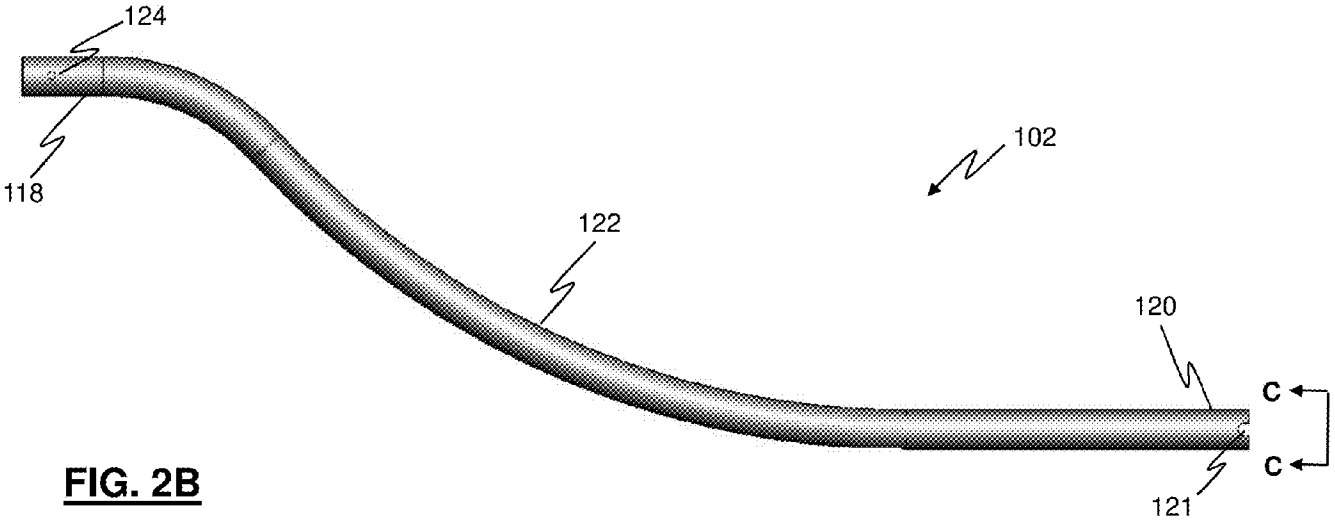
FIG. 2B is side view of a first tubular curved end piece of the curved shower rod assembly of FIG. 2A.
Figure 2C:
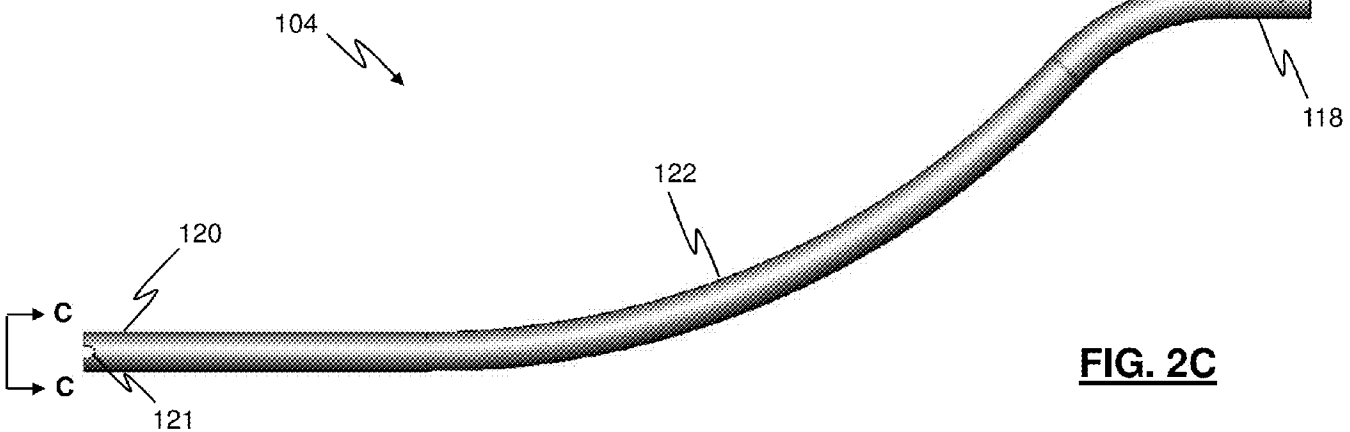
FIG. 2C is side view of a second tubular curved end piece of the curved shower rod assembly of FIG. 2A.
Figure 2E:
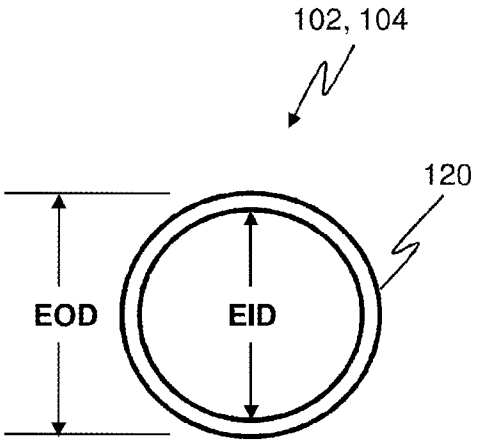
FIG. 2E is sectional view of the first and second curved end pieces of FIG. 2B and FIG. 2C.

In accordance with one embodiment of the invention and referring to FIG. 2A, FIG. 2B and FIG. 2C, an easily adjustable curved shower rod assembly 100 is provided and includes a first tubular curved end piece 102, a second tubular curved end piece 104, a substantially straight center tubular piece 106, a screw rod 108, two threaded sleeves 110 having a sleeve notch 111, two ferrules 112, two wall mounts or mounting brackets 114 and two bracket pins 116. Each of the first curved end piece 102 and second curved end piece 104 include a bracket end 118 and a center or interface end 120, where the bracket end 118 and interface end 120 are substantially straight and separated by a curved portion 122. The bracket end 118 includes a pair of rod mounting holes 124 for connecting to the mounting brackets 114 and the interface ends 120 include a interface end notch 121 for interacting with the sleeve notch 111 of the threaded sleeves 110, as discussed further hereinafter.

Figure 2D:
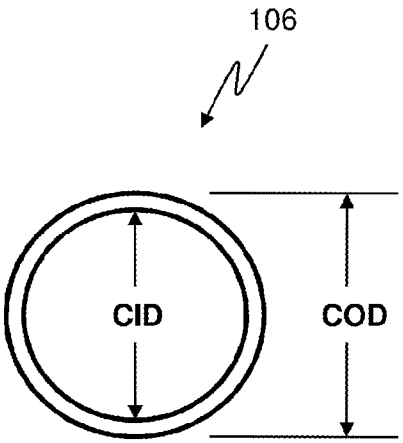
FIG. 2D is sectional view of a center tubular piece of the curved shower rod assembly of FIG. 2A.

Referring to FIG. 2D, each of the first curved end piece 102 and second curved end piece 104 include an end piece outer diameter EOD and an end piece inner diameter EID (See Section C-C). Additionally, the center tubular piece 106 includes a center piece inner diameter CID and a center piece outer diameter COD (See Section B-B), where the center piece inner diameter CID is larger than the end piece outer diameter EOD. For example, in one embodiment the end piece outer diameter EOD is about ⅞ inches and the center piece inner diameter CID is about 1 inch. This configuration advantageously allows the interface end 120 of the first and second curved end pieces 102, 104 to slide into and out of the center piece 106 such that the length of the shower rod 100 is adjustable. It is contemplated that in other embodiments, the above configuration may be arranged such that the center piece 106 slides into and out of the interface end 120 of the first and second curved end pieces 102, 104.

Figure 3A:
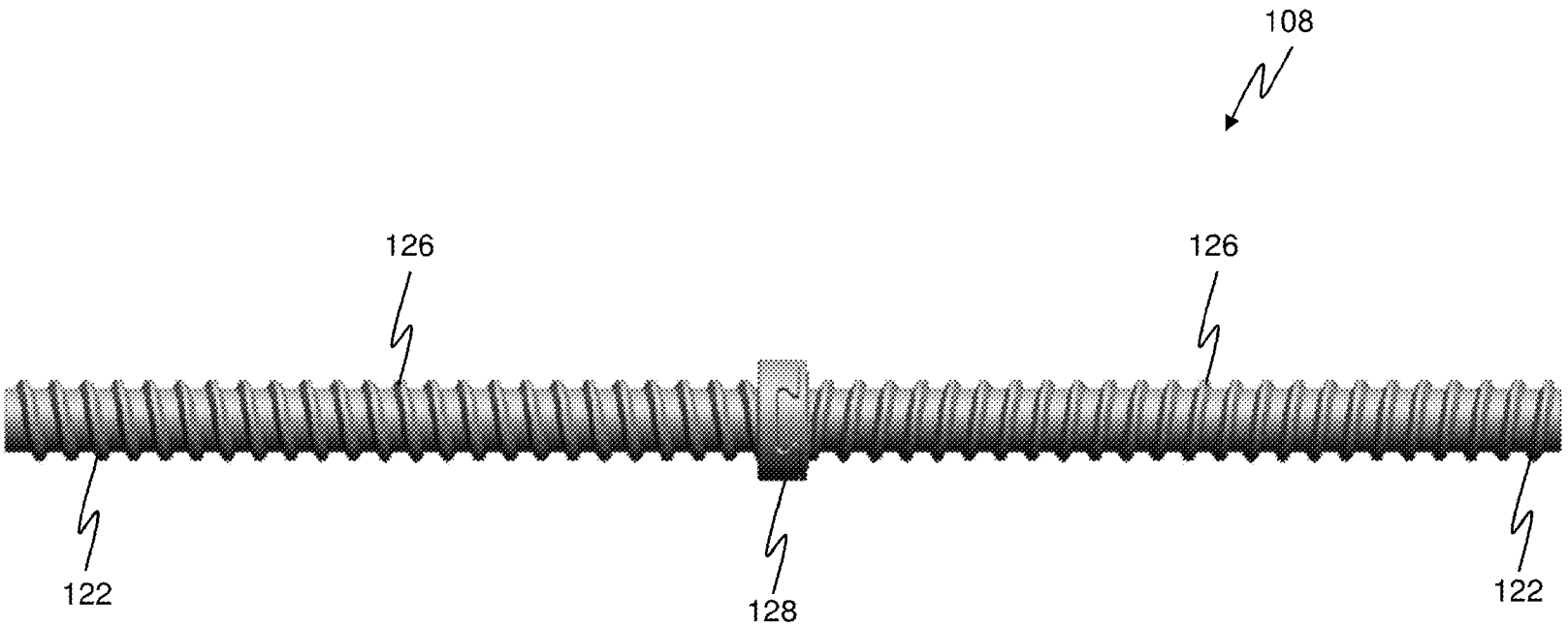
FIG. 3A is side view of one embodiment of a screw rod of the curved shower rod assembly of FIG. 2A, in accordance with one embodiment.
Figure 3B:
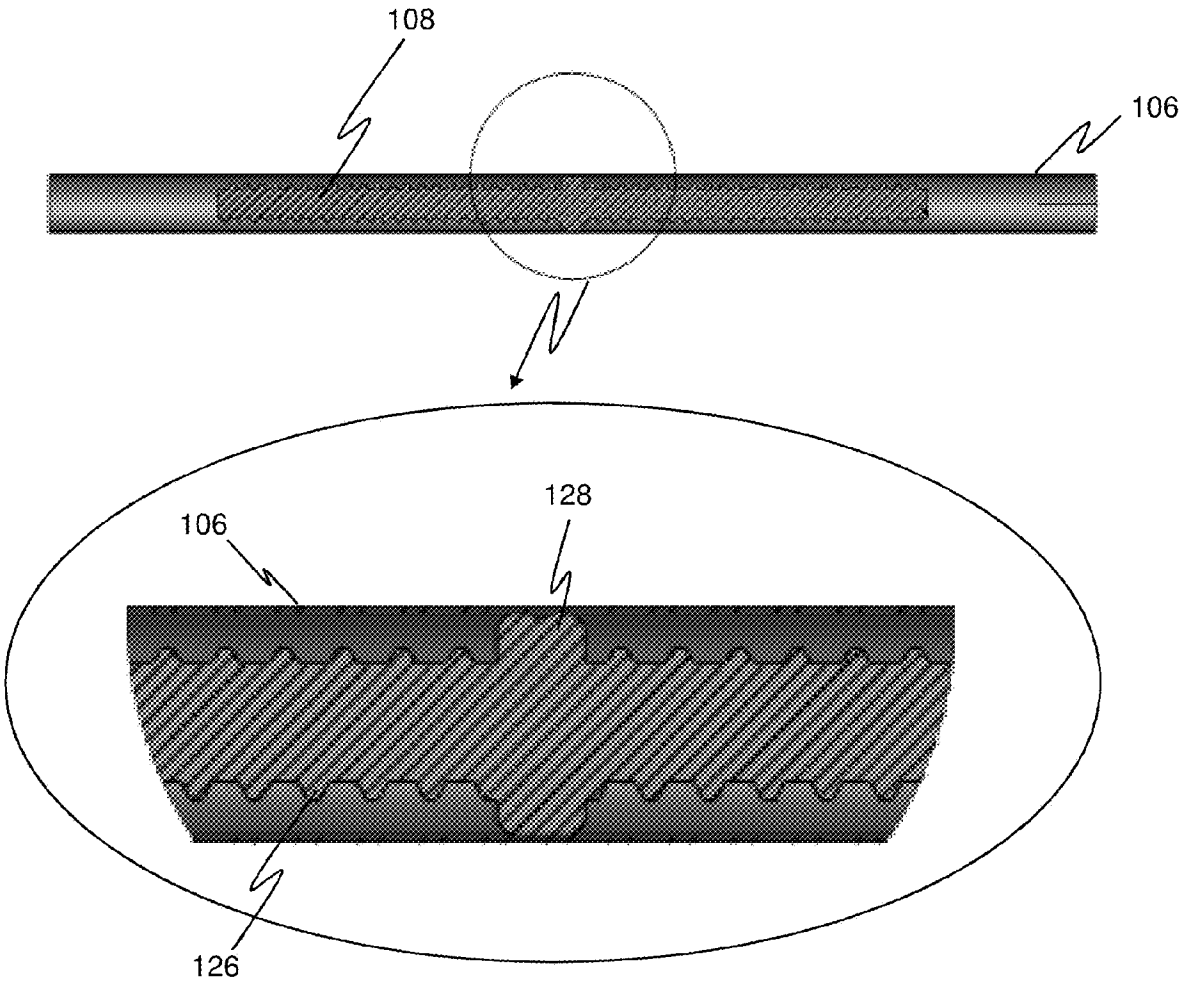
FIG. 3B is side sectional view of the screw rod of FIG. 3A located in the center piece of FIG. 1C.
Figure 3C:
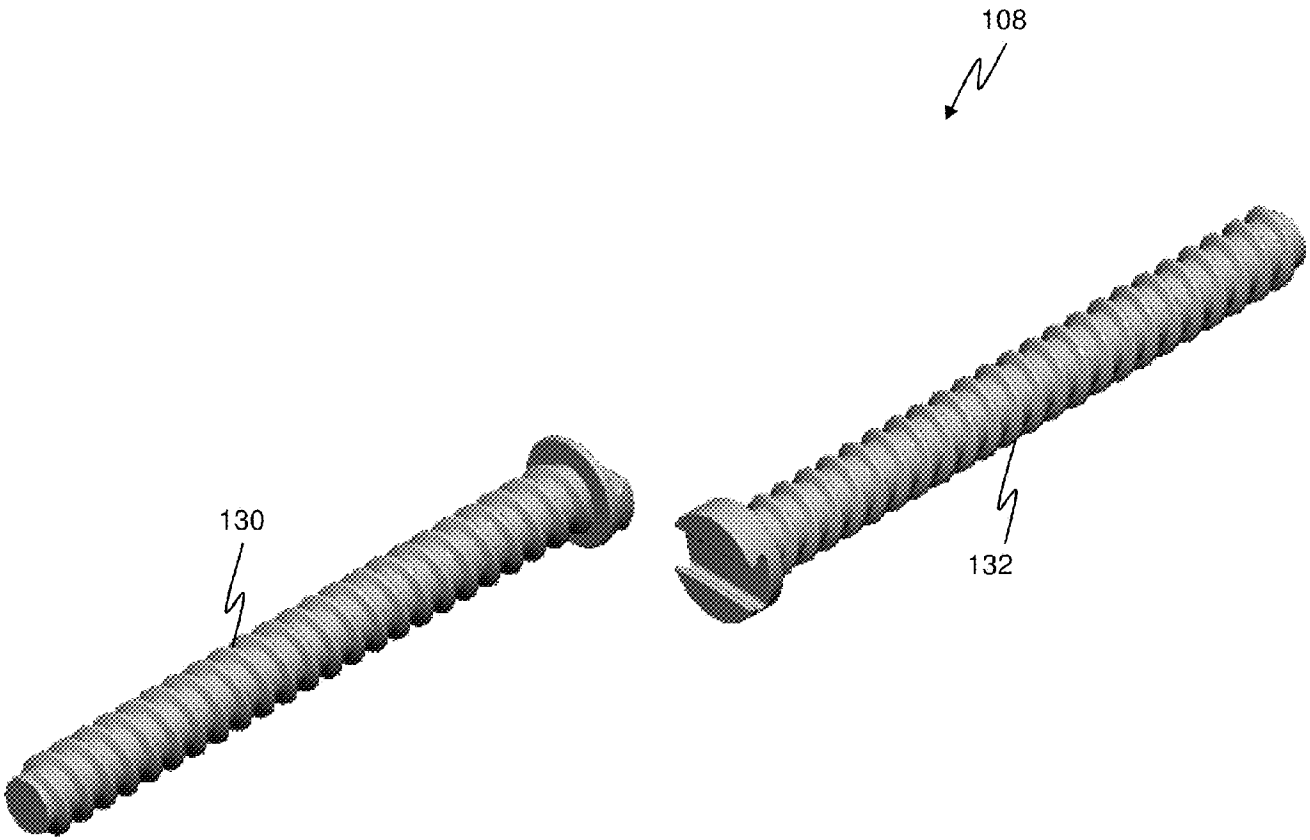
FIG. 3C is side view of a screw rod of the curved shower rod assembly of FIG. 2A, in accordance with another embodiment.
Figure 3D:
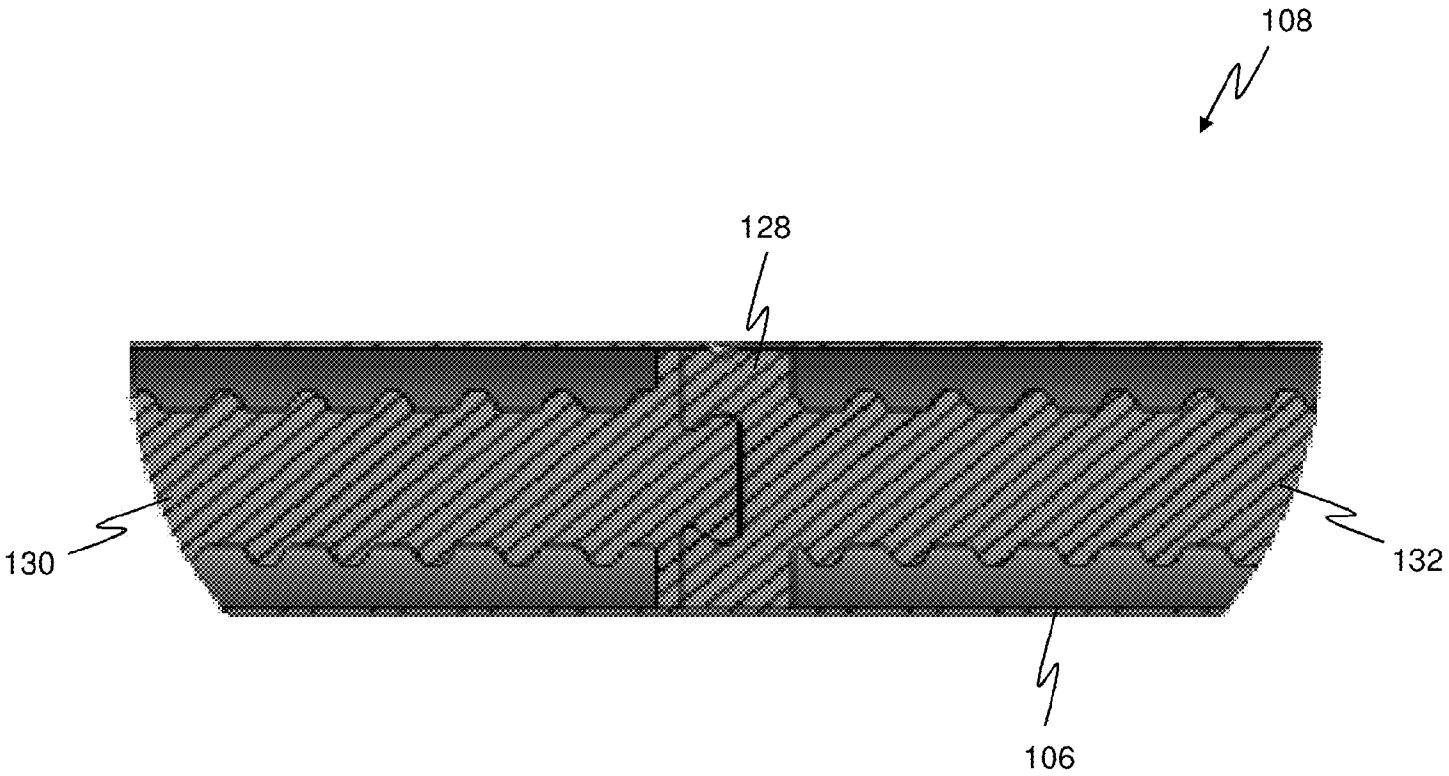
FIG. 3D is side sectional view of the screw rod of FIG. 3C located in the center piece of FIG. 1C.
Figure 3E:
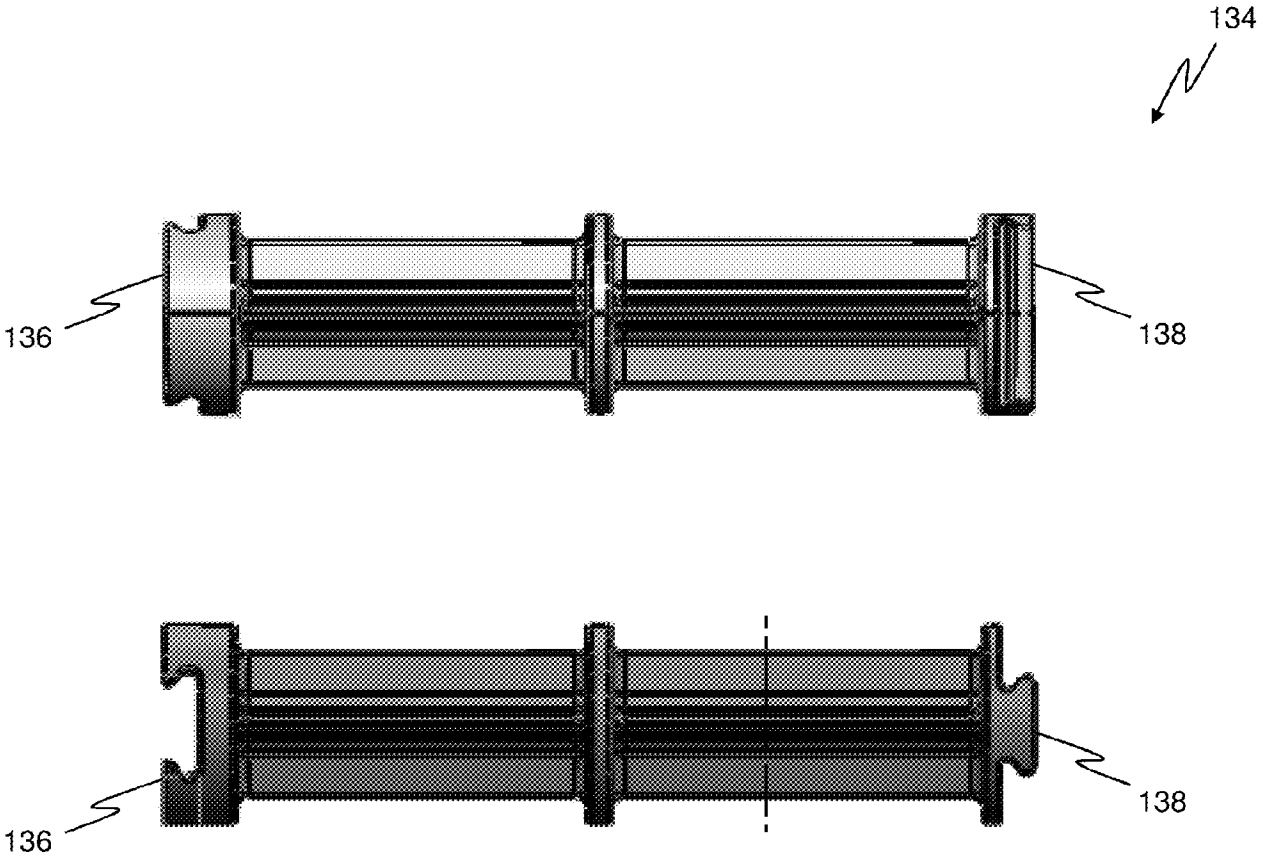
FIG. 3E is side sectional view of an adapter for the screw rod of FIG. 3C.

Referring to FIG. 3A and FIG. 3B, the screw rod 108 includes opposing-end left and right threads 126 and a raised center portion 128 that is sized to frictionally engage with the inner surface of the center piece 106. The screw rod 108 may be slidably press fit into the center piece 106 to be securely contained therein and as such, when the screw rod 108 is located within the center piece 106, the screw rod 108 is frictionally and securely contained therein. Referring to FIG. 3C and FIG. 3D, one embodiment of the screw rod 108 is shown and includes a first rod end 130 and a second rod end 132, where one end of the first and second rod ends 130, 132 are keyed to fit together when joined, where when joined together the first rod end 130 and second rod end 132 form the raised center portion 128. Referring to FIG. 3E, this configuration allows for the use of an adapter 134 which may be used to expand the length of the screw rod 108. As shown, the adapter 134 includes a first adapter end 136 and a second adapter end 138, where the first adapter end 136 is keyed to fit the end of the first rod end 130 and the second adapter end 138 is keyed to fit the end of the second rod end 132. It should be appreciated that when the adapter 134 is used, the screw rod 108 has two (2) raised center portions 128 sized to frictionally engage with the inner surface of the center piece 106.

Figure 3F:
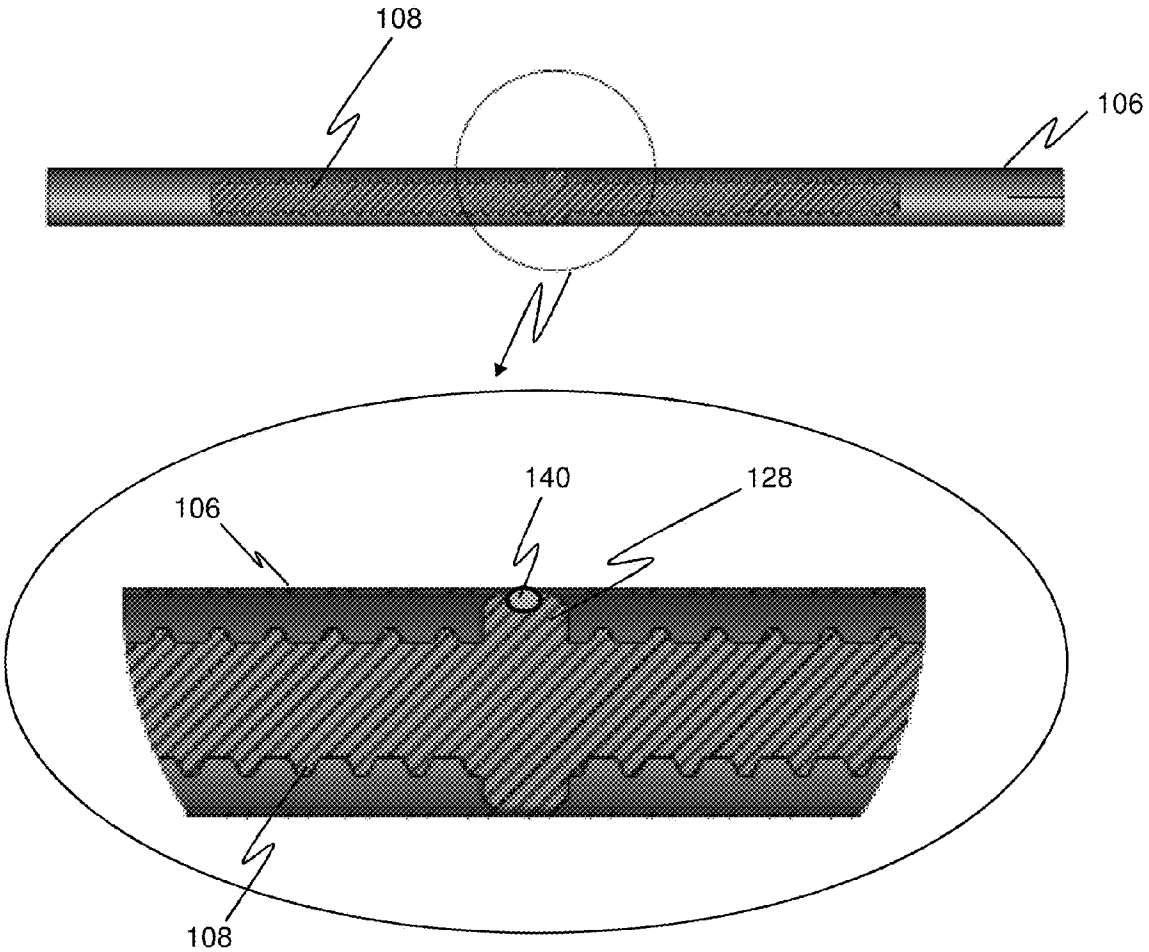
FIG. 3F is top view of another embodiment of the screw rod/center piece combination of FIG. 3A.

Referring to FIG. 3F, it is contemplated that in another embodiment, a secondary detent 140 in the center piece 106 may be included where the secondary detent interacts with the raised center portion 128 to retain (or help retain) the screw rod 108 within the center piece 106. In still yet another embodiment, a retaining strip may be attached to the top of the raised center portion 128 of the screw rod 108, where the retainer strip is configured to engage the inner surface of the center piece 106 to prevent/limit rotation of the screw rod 108 within the center piece 106. For example, one (or both) ends of the retaining strip may be slightly protruding from the raised center portion 128 such that if the screw rod 108 rotates relative to the center piece 106 the ends of the retaining strip digs into the inner surface of the center piece 106 and limits/prevents rotation of the screw rod 108 relative to the center piece 106.

In still yet another embodiment, the retaining strip may include one or more barbs that protrude from the surface of the retaining strip such that if the screw rod 108 rotates relative to the center piece 106 the one or more barbs dig into the inner surface of the center piece 106 and prevent rotation of the screw rod 108 relative to the center piece 106. In another embodiment, an adhesive may be provided on the surface of the retaining strip to interact with the inner surface of the center piece 106 is also contemplated.

Figure 4A:
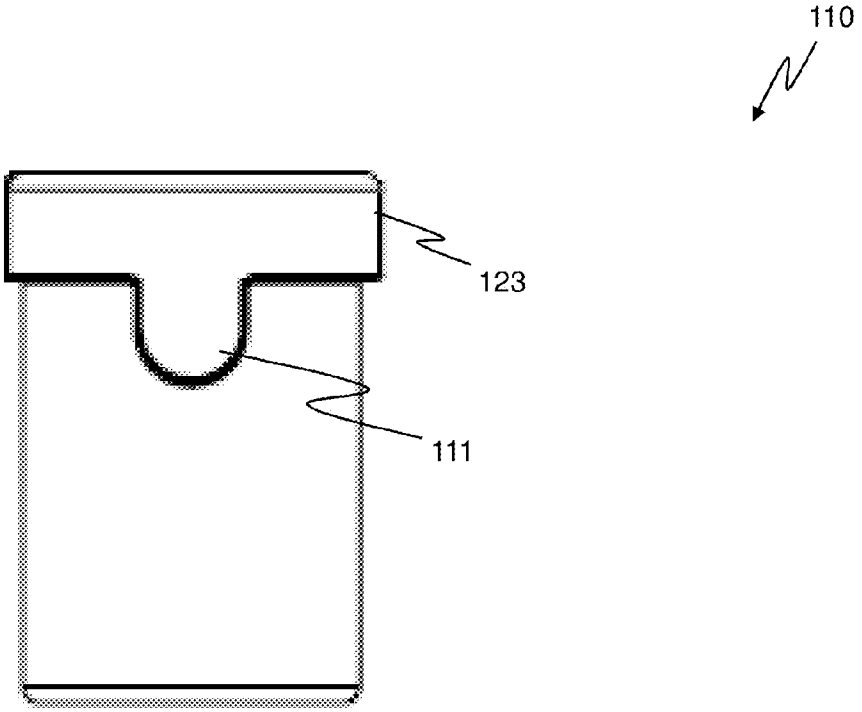
FIG. 4A is side view of the threaded sleeve of the curved shower rod of FIG. 1A.
Figure 4B:
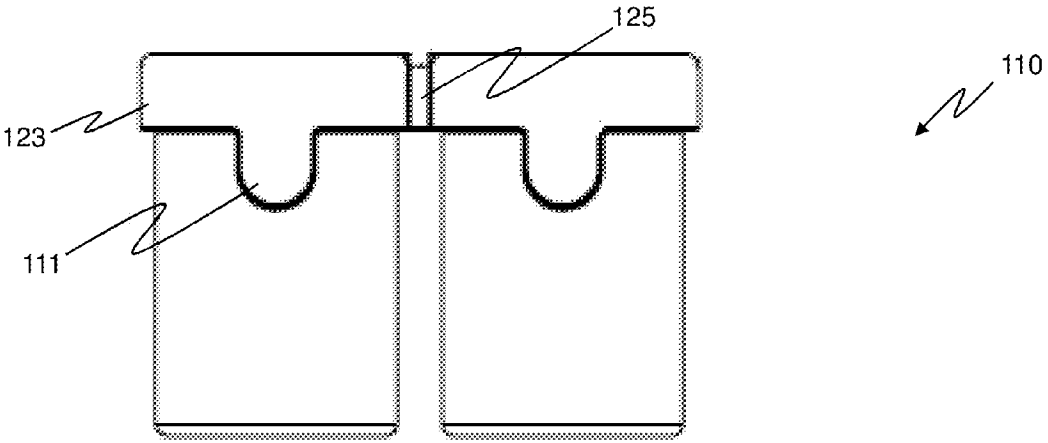
FIG. 4B is side view of the outside of the threaded sleeve of FIG. 4A.
Figure 4C:
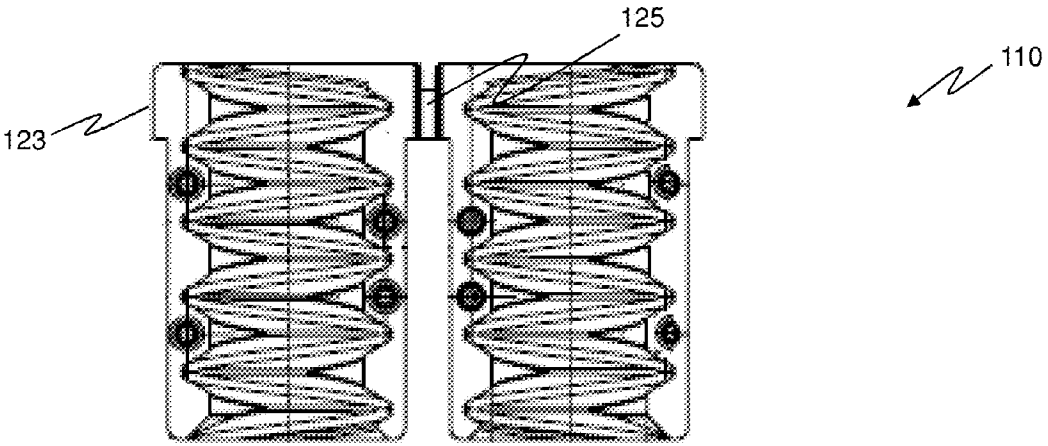
FIG. 4C is side view of the inside of the threaded sleeve of FIG. 4A showing the threaded portion.

Referring to FIG. 4A, FIG. 4B and FIG. 4C, the threaded sleeves 110 are non-movably contained within interface ends 120 of the first and second tubular curved end pieces 102, 104 and include bi-directional threads (i.e. both right-hand threads and left-hand threads) that are configured and sized to threadingly engage with the opposing-end left and right threads 126 of the screw rod 108. It should be appreciated that the threaded sleeves 110 are sized and shaped to snugly fit within the interface ends 120 such that the sleeve notch 111 engages with the interface end notch 121. Additionally, the threaded sleeves 110 include a collar 123 that is sized so that it will not fit within the interface ends 120. Accordingly, the combination of the collar 123 and the sleeve notch/interface end notch 111, 121 prevents that threaded sleeves 110 from rotating and from being pushed too far into the first and second tubular curved end pieces 102, 104. It should be appreciated that although the threaded sleeves 110 are shown as being constructed from two (2) portions that are associated via a hinging portion 125, the threaded sleeves may be constructed without a hinged portion (in two non-connected pieces) or as a solid threaded sleeve 110. It should be appreciated that the threaded sleeve is configured with internal right-hand threads and internal left-hand threads such that the threaded sleeve can threadingly engage a screw body having either right-hand threads or left-hand threads. This concept is discussed in greater detail in U.S. patent application Ser. No. 13/420,934, the contents of which are incorporated by reference herein in its entirety.

Figure 5:
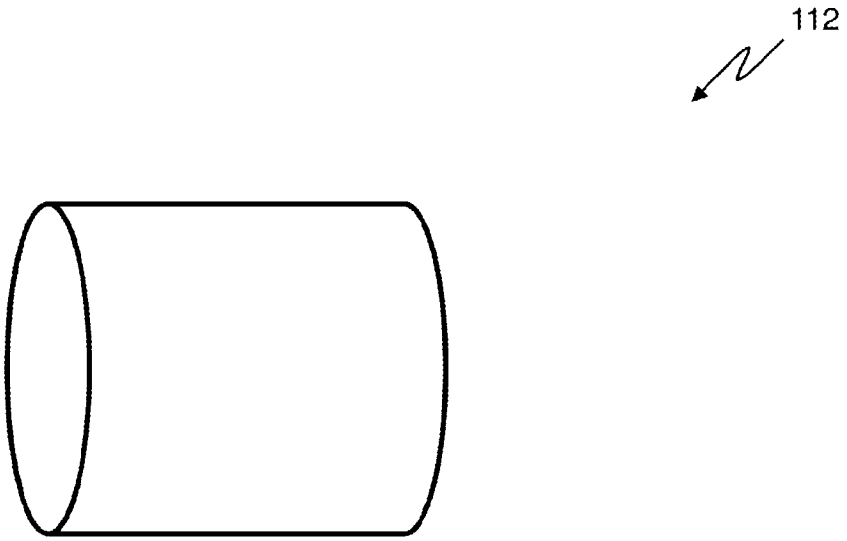
FIG. 5 is side view of a ferrule used with the curved shower bar assembly of FIG. 1A.

Referring to FIG. 5, the ferrules 112 are sized such that the ends of the center piece 106 fit snugly within and that the interface ends 120 of the first and second tubular curved end pieces 102, 104 are allowed to move within. As such, the ferrules 112 are located to cover the joint formed between the first and second curved end pieces 102, 104 and the center piece 106.

Figure 6A:
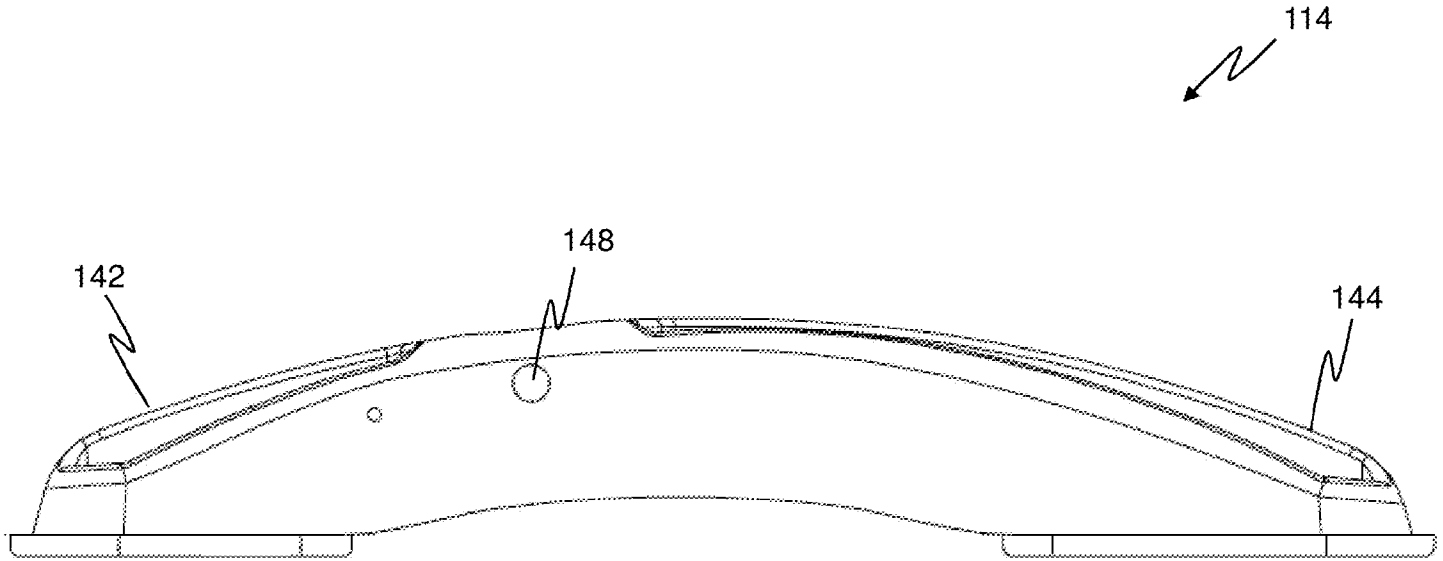
FIG. 6A is a side view of a mounting bracket for the curved shower rod assembly of FIG. 2A, in accordance with one embodiment.
Figure 6B:
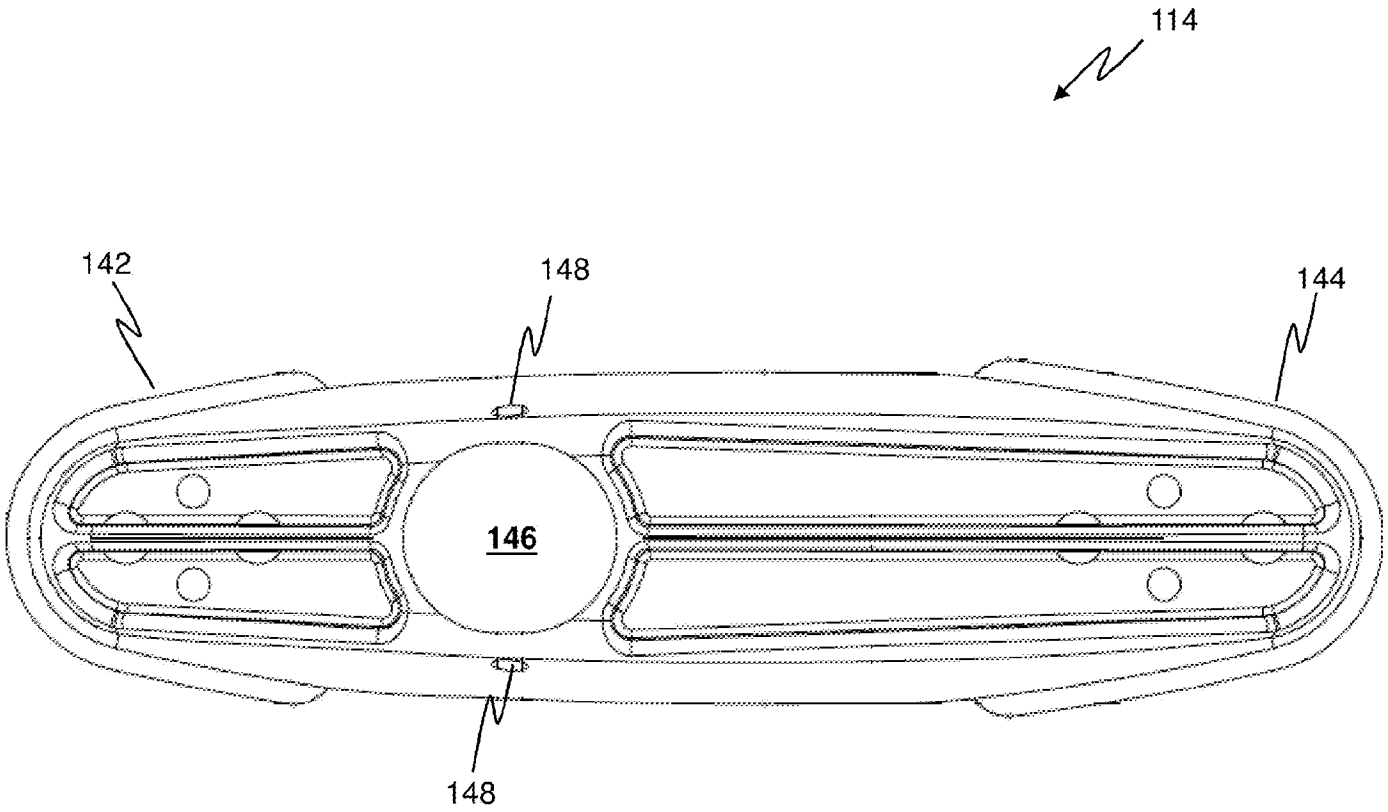
FIG. 6B is a top down view of the mounting bracket of FIG. 6A.
Figure 6C:
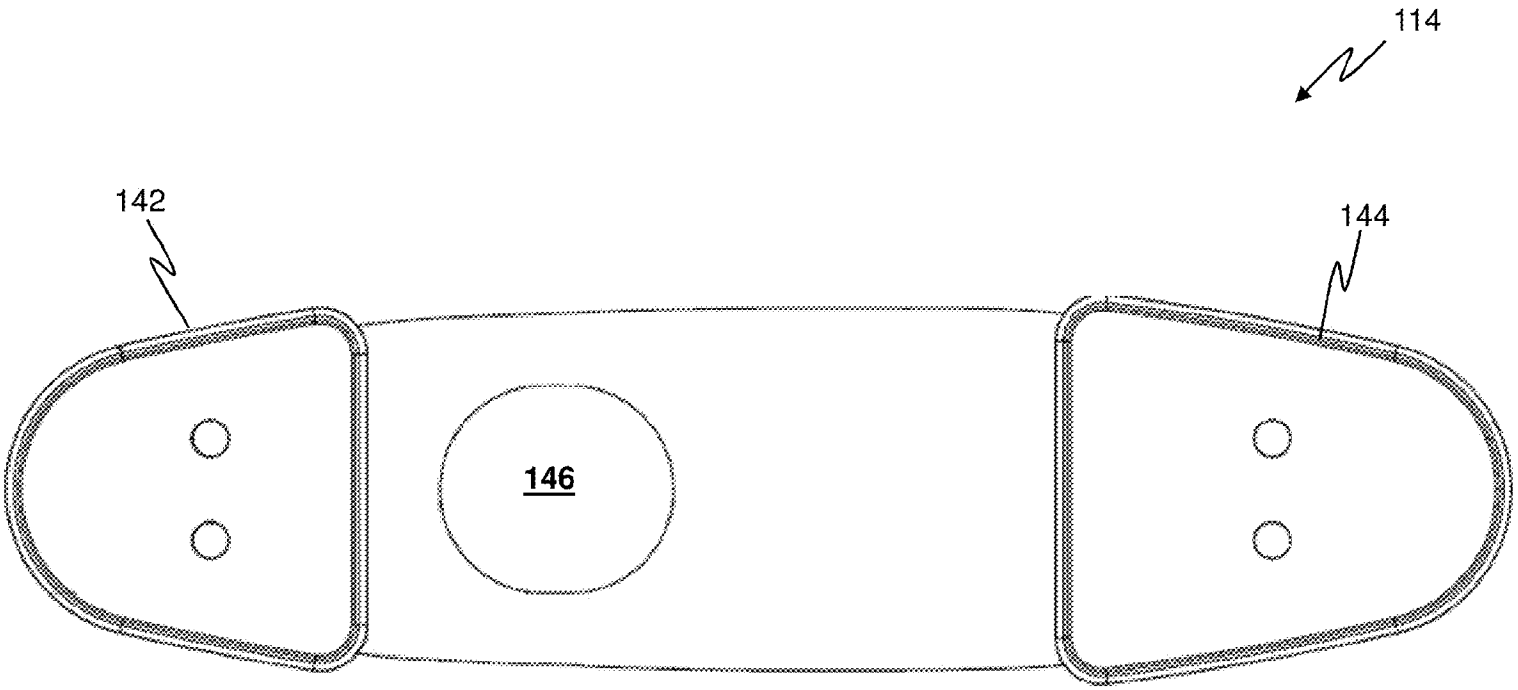
FIG. 6C is a bottom up view of the mounting bracket of FIG. 6A.
Figure 6D:
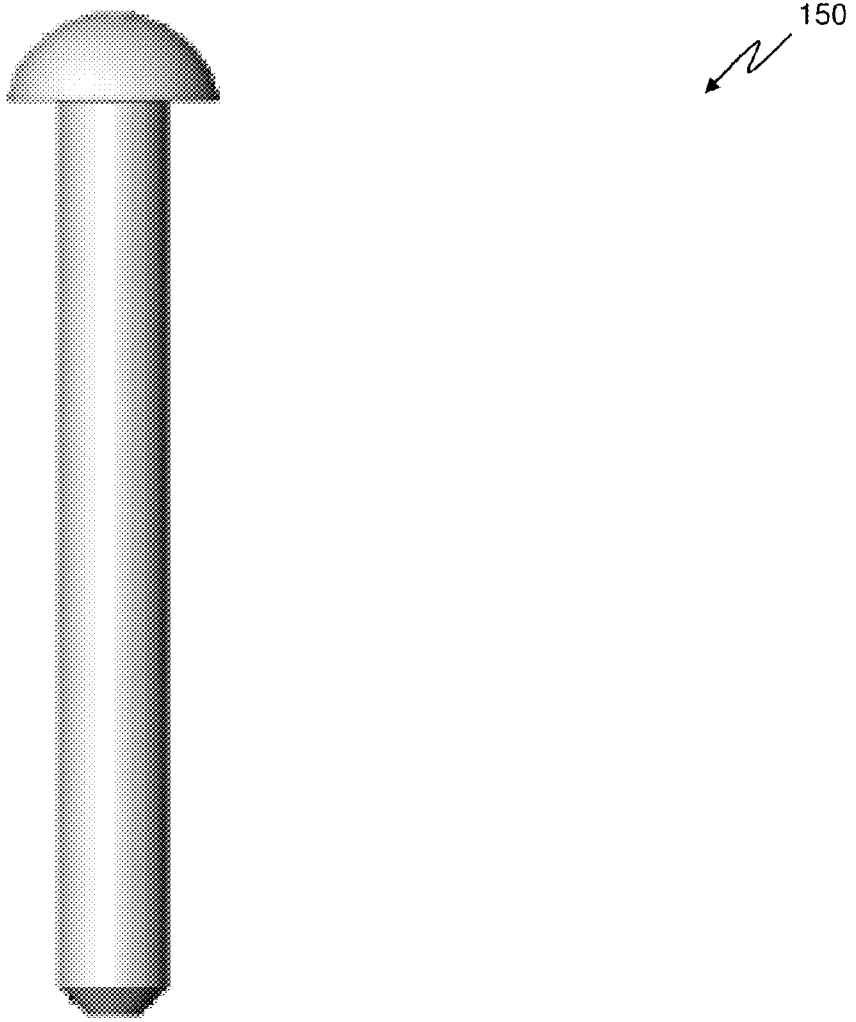
FIG. 6D is a mounting pin for the curved shower rod assembly of FIG. 2A.

Referring to FIG. 6A, FIG. 6B, and FIG. 6C, each of the mounting brackets 114 are essentially oblong in shape and include a bracket front 142 and a bracket rear 144, wherein the bracket front 142 defines a socket cavity 146 and a pair of mounting pin openings 148 communicated with the socket cavity 146 and located on opposing sides of the socket cavity 146. The socket cavity 146 is located to be offset from the center of the mounting bracket 114 toward one side of the mounting bracket 114 (i.e. proximate the front 142 of the bracket 114). Moreover, the socket cavity 146 is sized and shaped to receive the bracket end 118 of the first and second curved end pieces 102, 104, such that when one of the first curved end piece 102 and second curved end piece 104 are located within the socket cavity 146, the pair of mounting pin openings 148 and pair of rod mounting holes 124 are aligned. Referring to FIG. 6D, mounting pins 116 are provided and are sized and shaped so that they can be inserted through the pair of mounting pin openings 148 and pair of rod mounting holes 124 to securely retain the bracket end 118 of one of the first and second curved end pieces 102, 104 therein.

Figure 6E:
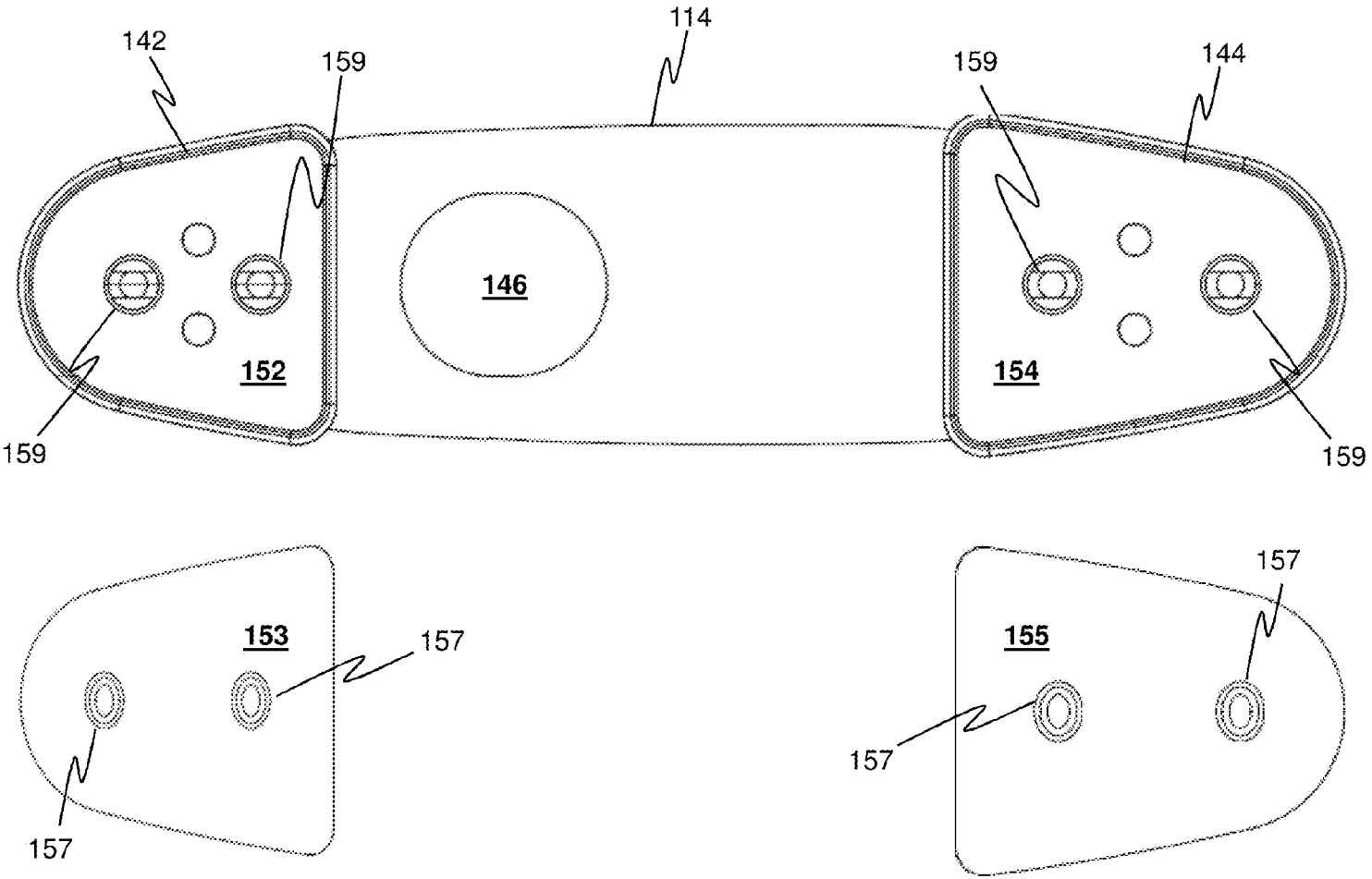
FIG. 6E is a bottom up view of a mounting bracket for the curved shower rod assembly of FIG. 2A showing footpads, in accordance with another embodiment.
Figure 6F:
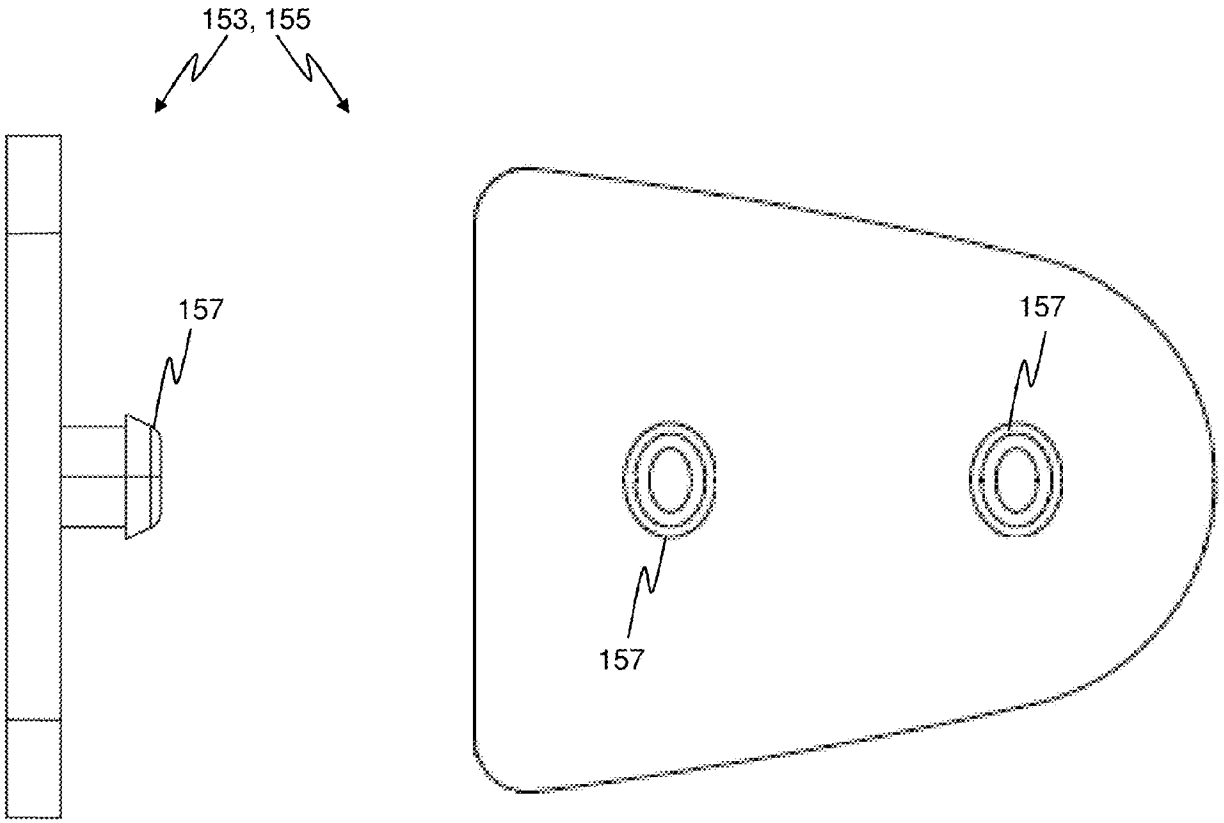
FIG. 6F is a top down and side view of the footpad of FIG. 6E.
Figure 7A:
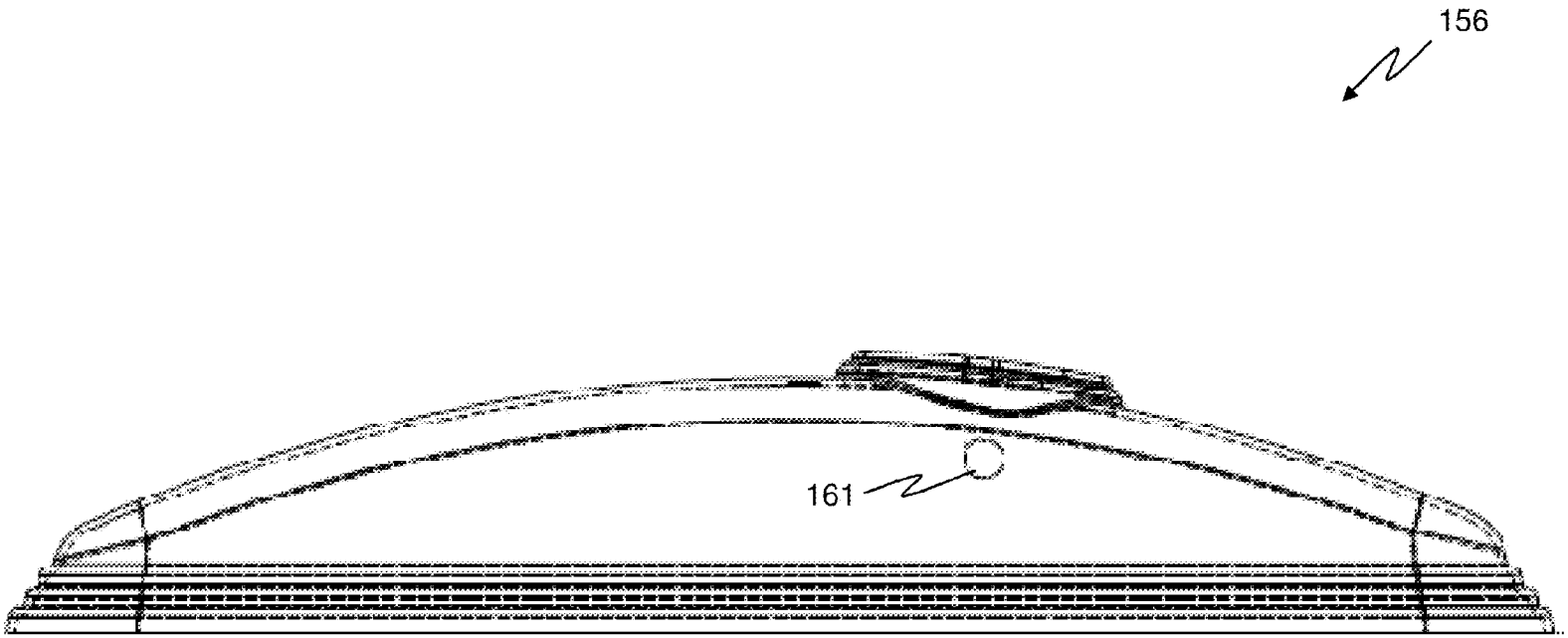
FIG. 7A is a side view of a mounting bracket cover for the curved shower rod assembly of FIG. 2A.
Figure 7B:
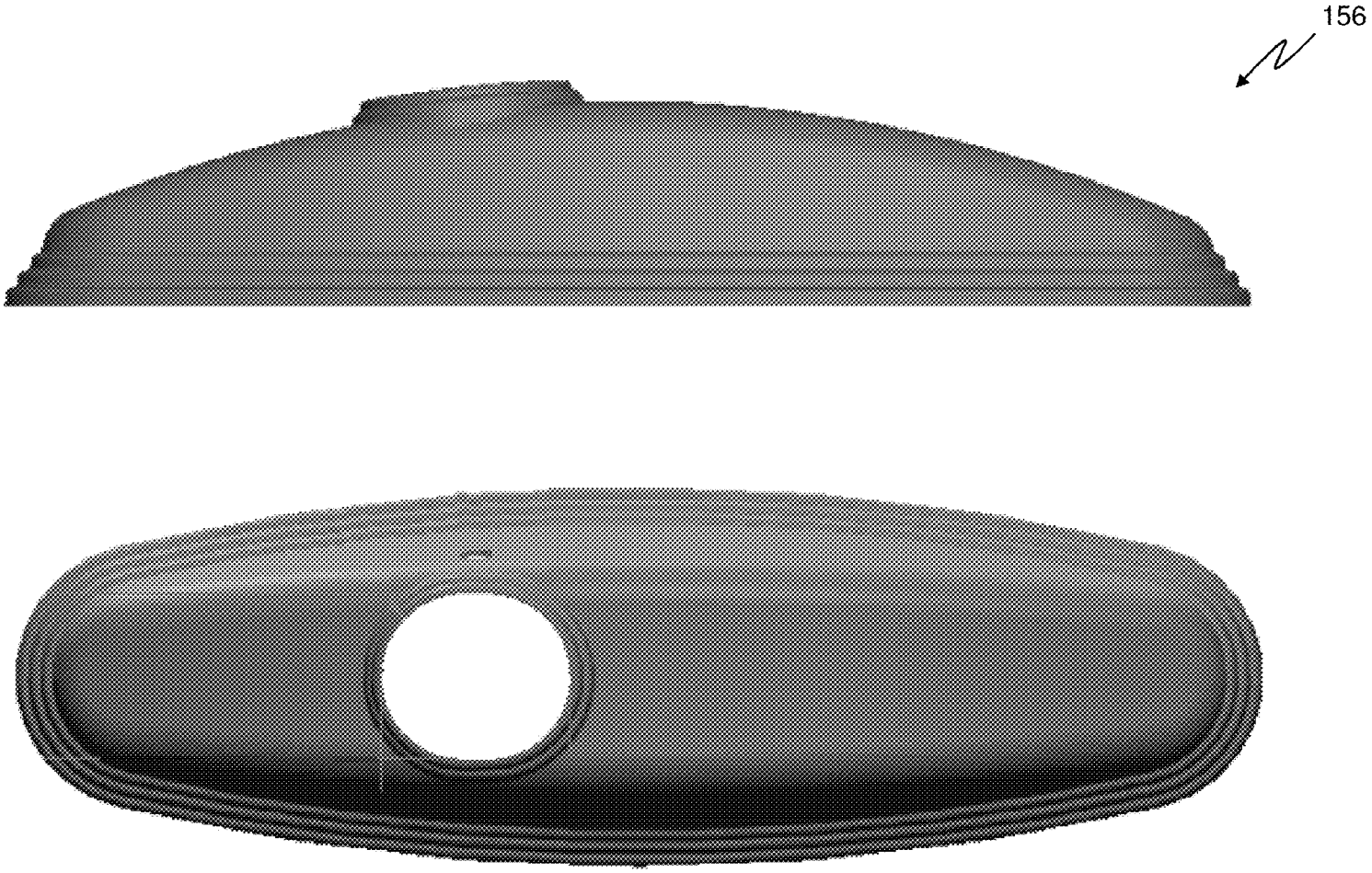
FIG. 7B is a top down and side isometric view of the mounting bracket cover of FIG. 7A.

Additionally, referring again to FIG. 6E, the bottom surface of the bracket front 142 and bracket rear 144 of the mounting brackets 114 may include a first footpad surface 152 and a second footpad surface 154, respectfully. Accordingly, a first footpad 153 is located on the first footpad surface 152 and a second footpad 155 is located on the second footpad surface 154, wherein the first footpad 153 may be sized to be smaller than the second footpad 155 (although the footpads 153, 155 may be same size if desired). It should be appreciated that the first and second footpads 153, 154 may be securely attached to the first and second footpad surface 152, 154, respectively, via an adhesive or via a frictional mount. For example, referring again to FIG. 6E and FIG. 6F, the first and/or second footpads 153, 155 may include protrusions 157 and the mounting bracket 114 may include footpad insert cavities 159, where the protrusions 157 and footpad insert cavities 159 are sized and configured such that the protrusions 157 are inserted into the footpad insert cavities 159 and securely contained therein. Additionally, it should be appreciated that the first and second footpads 153, 155 may be constructed from a rubber, plastic material or other material which increases the frictional engagement between the wall and the bracket 114. Referring to FIG. 7A and FIG. 7B, it is contemplated that the mounting brackets 114 may also include a decorative trim outer cover 156 which may include a trim cover pin opening 161 and which may be configured to cover the mounting bracket 114 via a snap, clip, screw or adhesive.

Referring to the several figures, the shower rod assembly 100 is assembled by configuring the screw rod 108 such that the keyed first and second rod ends 130, 132 are mated together to form a single screw rod 108 (See FIGS. 3A-3F). If the adapter 134 is used, then the keyed first and second rod ends 130, 132 are associated with the appropriately keyed first and second adapter ends 136, 138. The screw rod 108 is then located within the center piece tubing 106 such that the screw rod is snugly contained therein to be proximate the center of the center piece 106.

Figure 8A:
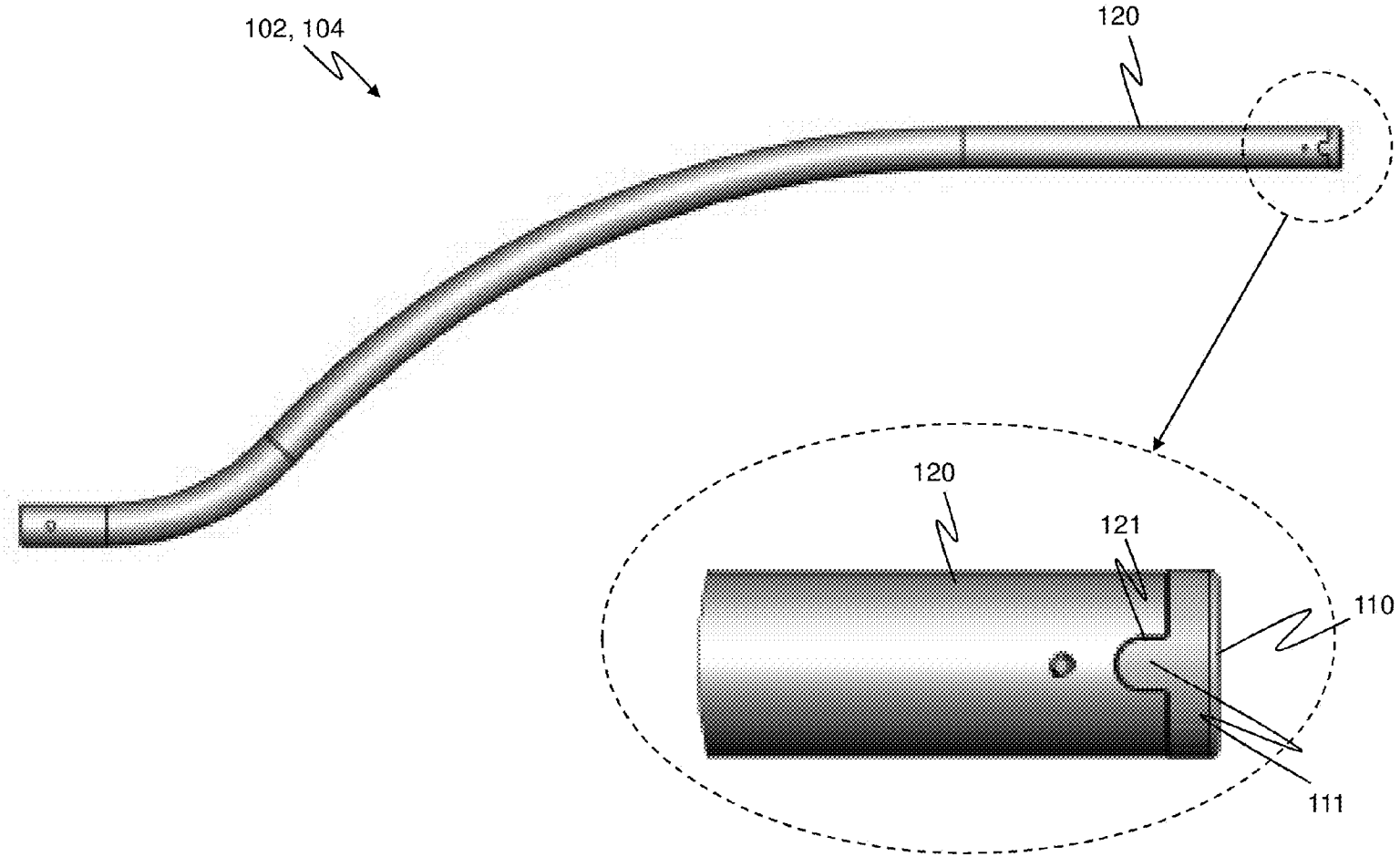
FIG. 8A is a side view of the bracket end of the curved end piece with the threaded sleeve of the curved shower rod assembly of FIG. 2A.
Figure 8B:
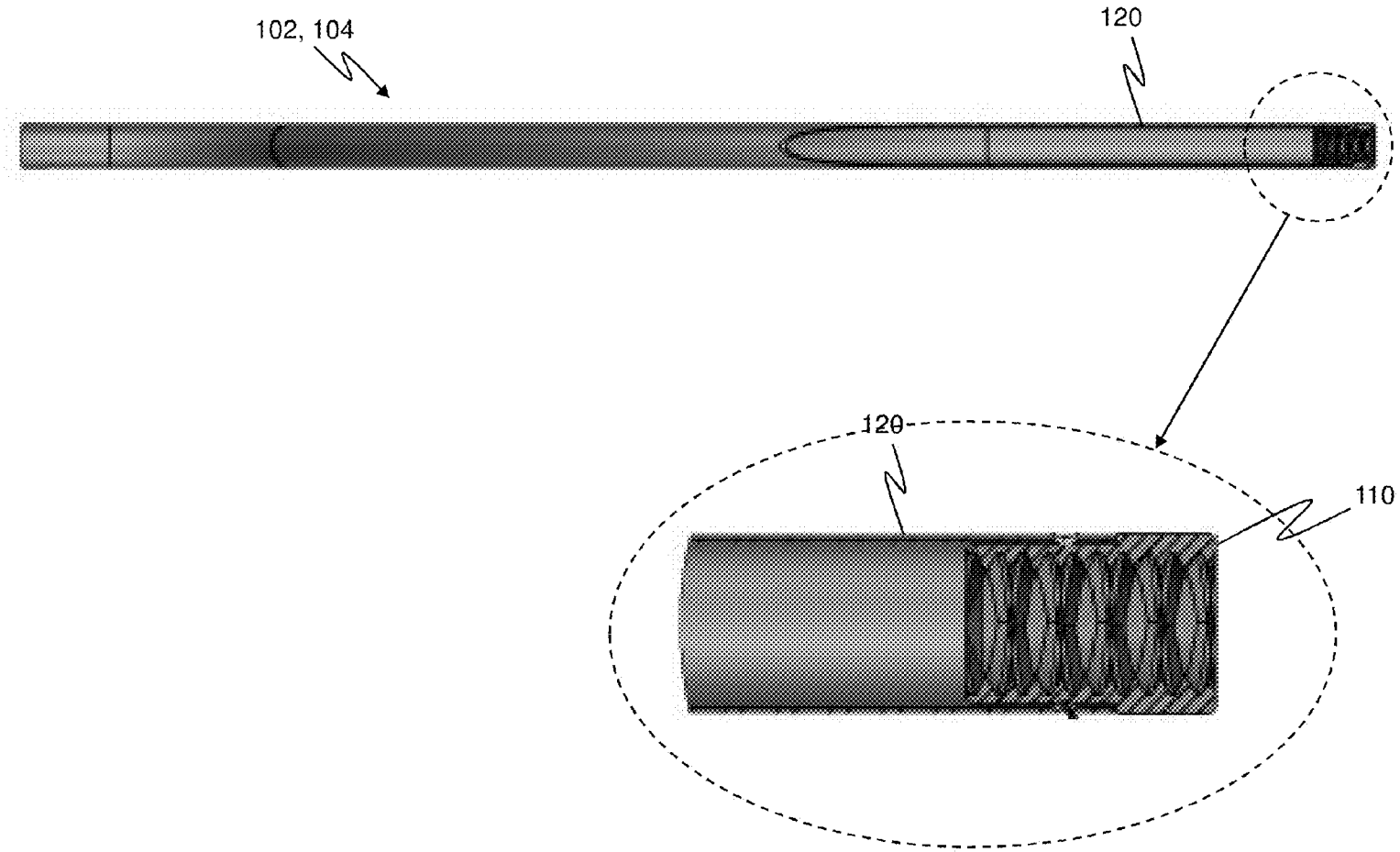
FIG. 8B a top down sectional view of the bracket end of the curved end piece with the threaded sleeve of FIG. 8A.

Referring to FIG. 8A and FIG. 8B, the threaded sleeves 110, which are sized and shaped to snugly fit into the interface ends 120 of the first and second curved end pieces 102, 104 are located therein such that the sleeve notch 111 is located within the interface end notch 121 and the collar 123 is pressed against the interface end 120. The ferrules 112 are then snugly associated with the ends of the center piece 106 to cover the ends of the center piece 106. The interface end 120 of the first curved end piece 102 is inserted into one end of the center piece 106 such that one end of the screw rod 108 is located within (or proximate to) the threaded sleeve 110 of the first curved end piece 102 and the interface end 120 of the second curved end piece 104 is inserted into the other end of the center piece 106 such that the other end of the screw rod 108 is located within (or proximate to) the threaded sleeve 110 of the second curved end piece 104. It should be appreciated that the ferrules 112 are also covering the joint formed between the interface ends 120 of the first and second curved end piece 102, 104 and the center piece 106.

The center piece 106 is rotated to cause the ends of the screw rod 108 to threadingly engage with the threads of the threaded sleeves 110 of the first and second curved end pieces 102, 104. In this way, the length of the curved shower rod 100 is adjustable by rotating the center piece 106. This is because when the center piece 106 is rotated relative to the first and second curved end pieces 102, 104 the screw rod 108 rotates as well. When the screw rod 108 is rotated in one direction, the threaded ends of the screw rod 108 threadingly engage the threads within the threaded sleeves 110 to cause the first and second curved end pieces 102, 104 to slide within the center piece 106 and move outwardly away from the center of the screw rod 108. When the screw rod 108 is rotated in the opposite direction, the threaded ends of the screw rod 108 threadingly engage the threads of the threaded sleeves 110 to cause the first and second curved end pieces 102, 104 to slide within the center piece 106 and move inwardly toward the center of the screw rod 108. In this manner, the length of the curved shower rod 100 is adjusted.

Figure 9:
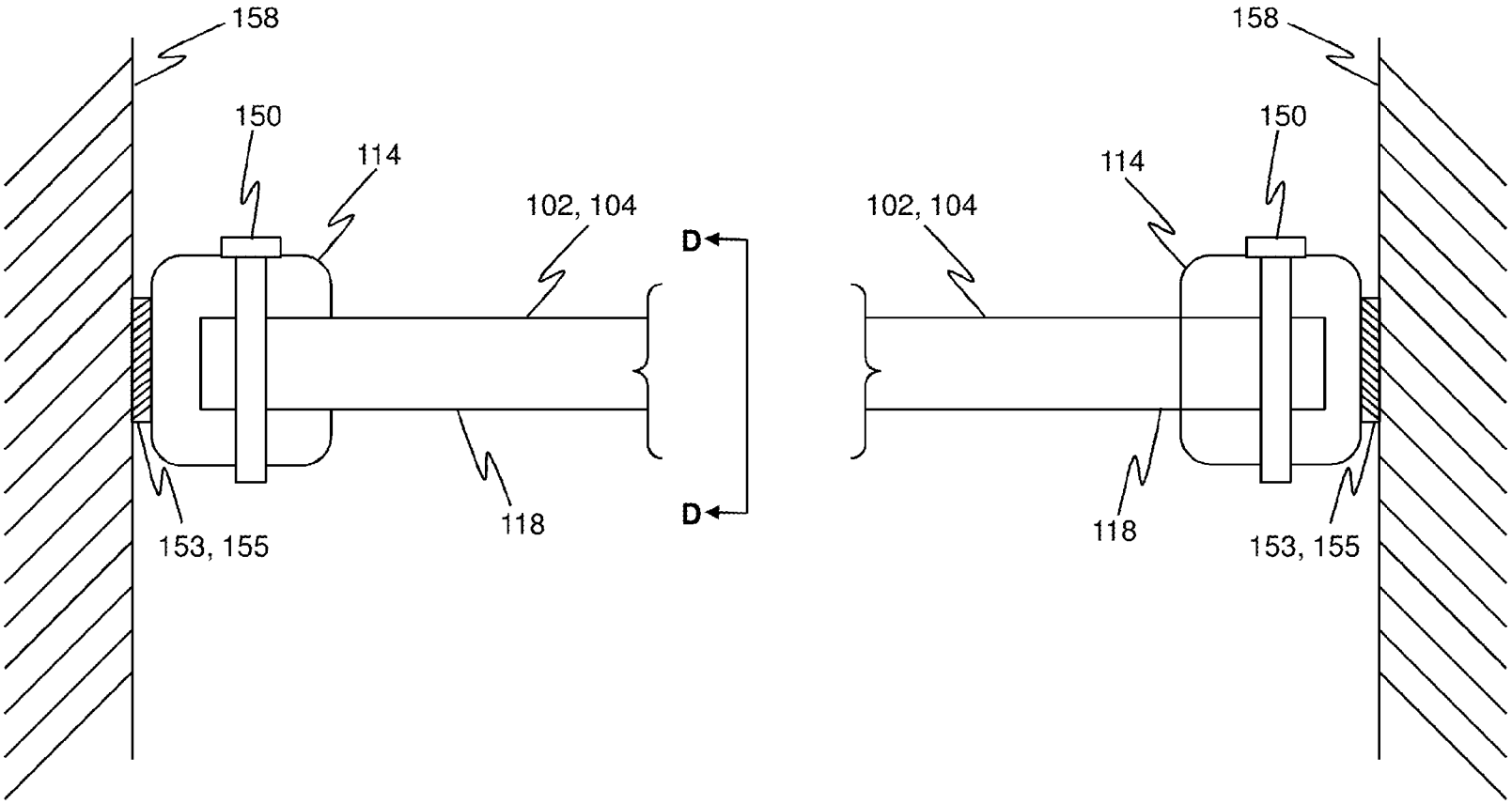
FIG. 9 is a side view of the curved shower rod system of FIG. 2A associated with shower walls, in accordance with the present invention.

Referring to the several figures and FIG. 9, when installed in a shower, the bracket end 118 of the first and second curved end pieces 102, 104 are located within the socket 146 of the mounting brackets 114 such that the rod mounting holes 124 and mounting pin openings 148 are aligned. The bracket pins 116 are located within the rod mounting holes 124 and mounting pin openings 148. This prevents rotation of the first and second curved end pieces 102, 104 about the X-axis relative to the mounting brackets 114. The mounting brackets 114 are placed against or proximate opposing shower walls 158 of the shower stall. The center piece 106 is rotated relative to the first and second curved end pieces 102, 104 to cause the first and second curved end pieces 102, 104 to move outwardly away from the center piece 106 and toward the opposing shower walls 158. The center piece 106 is rotated until the first and second foot pads 152, 154 are pressing against the opposing shower walls 158 with enough force to keep the mounting brackets 114 from rotating about the X-axis.

Figure 10:
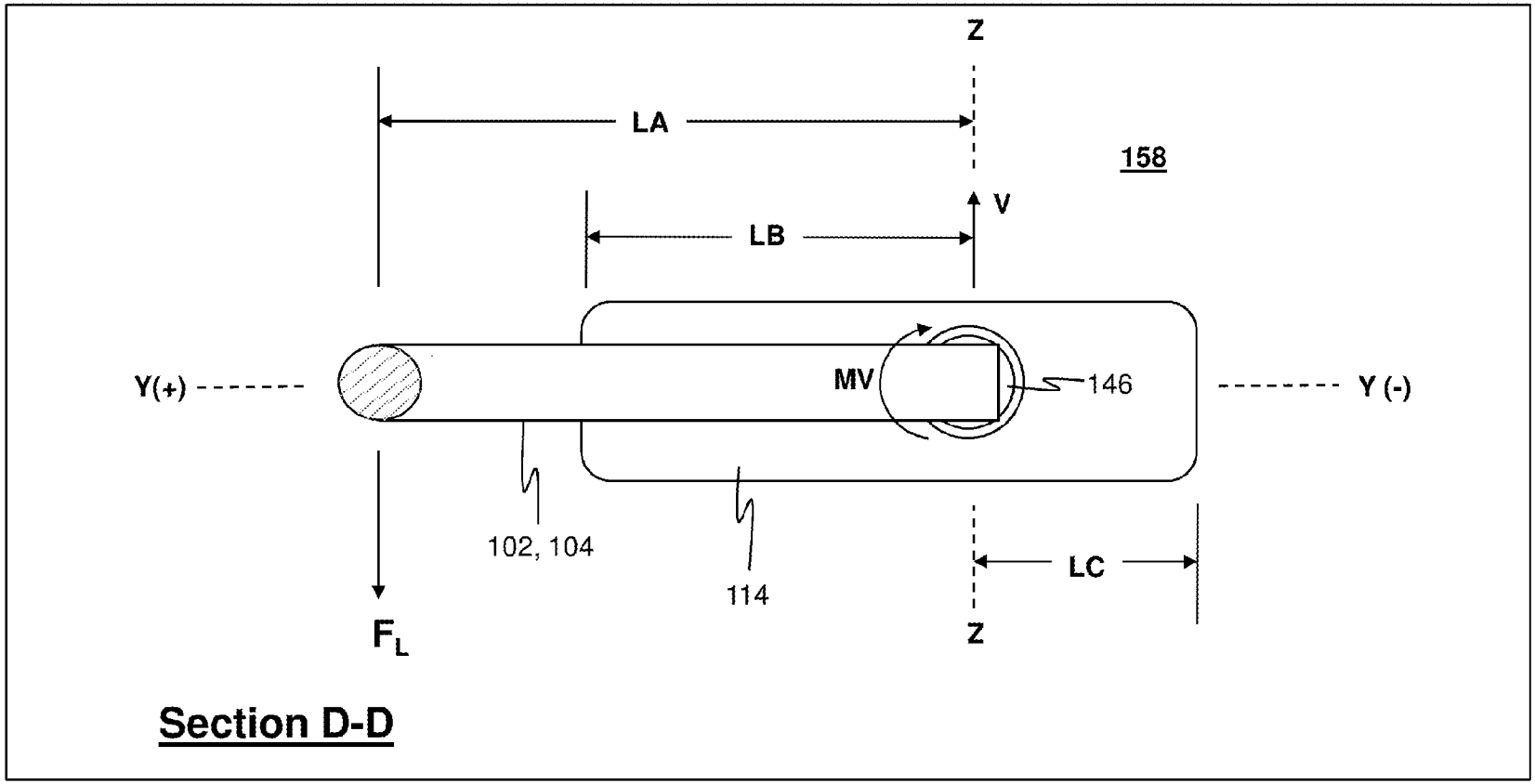
FIG. 10 is a sectional view of FIG. 9.

Referring to FIG. 10 which shows a cross Section D-D through the assembly shown in FIG. 9, the moment arm relationship is illustrated. The load on the curved rod (for example, from a shower curtain) which is typically equally distributed along part or all of the length of the rod is represented by a single force vector $F_L$ in this simplified view. The force $F_L$ is displaced in the Y(+) direction a distance LA from the X-axis that runs between the opposing sockets 146 of the opposing mounting brackets 114 (LA is the proximal distance between the center piece 106 and the X-axis).

In order to remain in place without rotation, the mounting bracket 114 must counter the forces $F_L$ applied by the curtain and pulling of a user. Thus, each typical mounting bracket 114 must provide an opposing vertical force V in the Z-axis direction to resist the vertical component of force $F_L$ and each bracket 114 must also provide a moment MV in the y-z plane to resist the torque created at socket 146 in the mounting bracket 114, where the end of the rod is located. These are accomplished via frictional engagement between the mounting bracket 114 (more specifically the first and second footpads 153, 155) and the shower wall 158. One way to create moment MV and resist the torque created at the socket 146 involves the length LB of the mounting bracket 114 (i.e. from the Z-axis plane) in the Y(+) direction being greater than the length LC of the mounting bracket 114 (i.e. from the Z-axis plane) in the Y(−) direction. It should be appreciated that in one embodiment the length LC from the socket 146 to the rear end 144 of the mounting bracket 114, i.e., the length LC, is about half of the length of the distance LB to the front end 162 of the mounting bracket 114.

In the generality of the invention, the length LC from the socket 146 to the rear end 144 of the mounting bracket 114, in the Y(−) direction, could be longer than shown, and it could be equal or greater than the length LB. However, in an exemplary embodiment, the mounting bracket 114 is asymmetrical, as described, to save material and avoid possible difficulties in mating an overly-long bracket with uneven shower wall surfaces.

Figure 11:
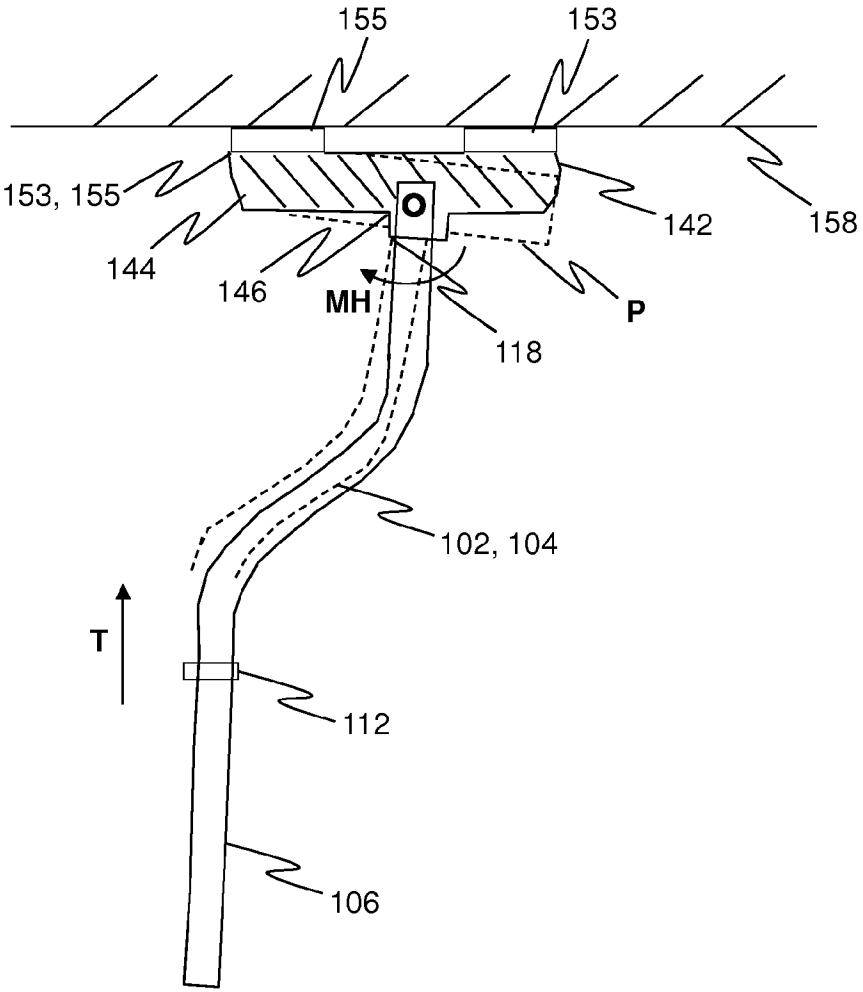
FIG. 11 is a top down view of FIG. 9.

It should be further appreciated that brackets 114 can be subject to torsional forces in the horizontal plane as well. Referring to FIG. 11, a top down view illustrating how the typical bracket 114 may engage a shower wall 158 is shown, where the bracket 114 is pressing the first and second footpads 153, 155 against the shower wall 158. The vector T represents the pressing force created by the action of screw rod 108, which is located within the center piece tube 106. Force T creates a moment MH in the x-y (horizontal) plane from bracket rear end 144 toward bracket front end 142. To the extent the bracket ends 118 of curved end pieces 102, 104 fits snugly (or tightly) within the socket cavity 146, the moment MH tends to cause the rear end 144 of the bracket 114 to pull away from the shower wall 158, as illustrated by the phantom view P, which is exaggerated here for purposes of illustration.

It is desirable for the bracket 114 (and the first and second footpads 153, 155 of the bracket 114) to maintain contact with the shower wall 158 at more than only the front end 142 of the bracket 114, i.e. at the front end 142 and the rear end 144 of the bracket 114, so that the resistive movement MV is effectively provided. Thus, in an embodiment of the invention, the first footpad 153 at the front end 142 of the bracket 114 may be made smaller, thicker or of a different material than the second footpad 155 at the rear end 144 of the bracket 114, so that the bracket 114 remains in contact despite the lifting tendency crated by moment MH.

In an additional embodiment, or in conjunction with the foregoing, the fit of the bracket end 118 of curved end pieces 102, 104 in the socket cavity 146 may be "sloppy" or loose. And the fit of the bracket pin 116 may also be "sloppy" or loose, as by means of oversized or elongated rod mounting holes 124 and mounting pin openings 148 relative to the diameter of the bracket pin 116. Thus, some bending of the curved end pieces 102, 104 could be accommodated without a lot of lifting effect.

It should also be appreciated that the first and second footpads 153, 155 of the brackets 114 may include an adhesive portion to give better frictional resistance between the first and second footpads 153, 155 and the shower wall 158. Also, the brackets 114 may be screwed to the shower wall 158. In that case, the relationship between the bracket dimensions and the offset of the shower rod will enable less stress to be applied to the screws, thereby lessening ware on the brackets 114 and/or the chance of fracturing on the shower wall 158 or will enable the use of smaller dimension screws, etc.

It is contemplated that the first and second curved end pieces 102, 104, and/or the center piece 106 may be constructed from a metallic material (for example, a metal having a wall thickness of about 0.02 inch). However, any material suitable to the desired end purpose, such as hard plastic or a composite material may be used. Furthermore, screw rod 108 may be constructed from metal, POM (acrylic) resin, metal, and/or some other suitable plastic and/or composite material. Additionally, the brackets 114 may be constructed from a strong metal, plastic and/or composite material, for instance ABS resin and the first and second footpads 153, 155 may be constructed from a rubber material, a plastic material or any other suitable material. It should be appreciated that in an exemplary embodiment, the first and second footpads 153, 155 have a Shore A Durometer of about 50-60.

Figure 12:
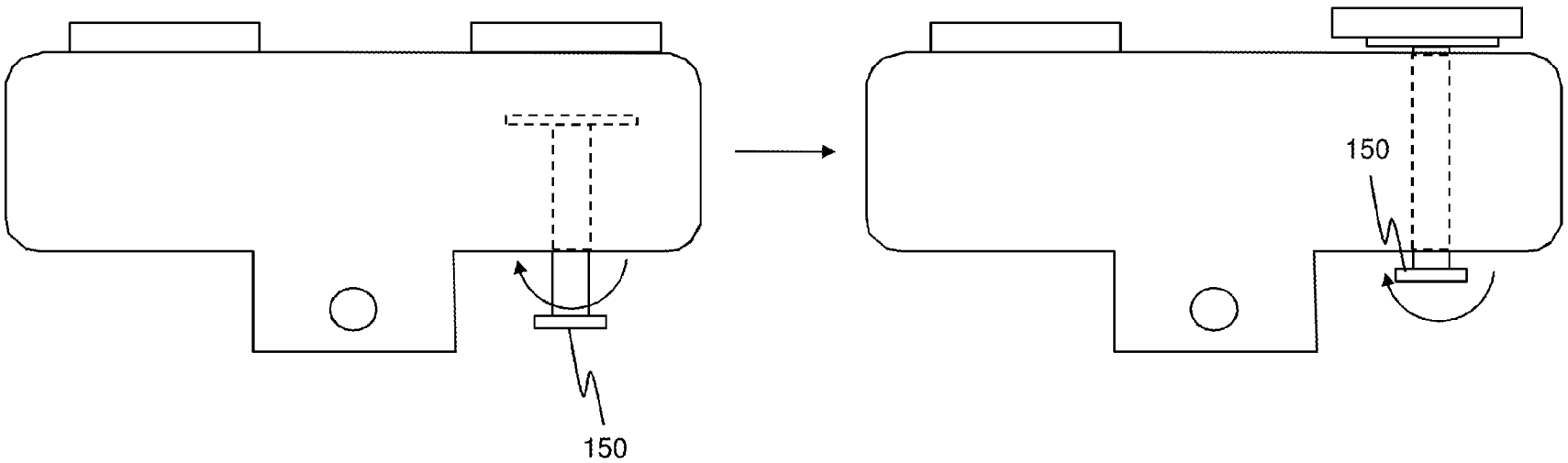
FIG. 12 is top down view of a mounting bracket, in accordance with another embodiment of the invention.
Figure 13A:
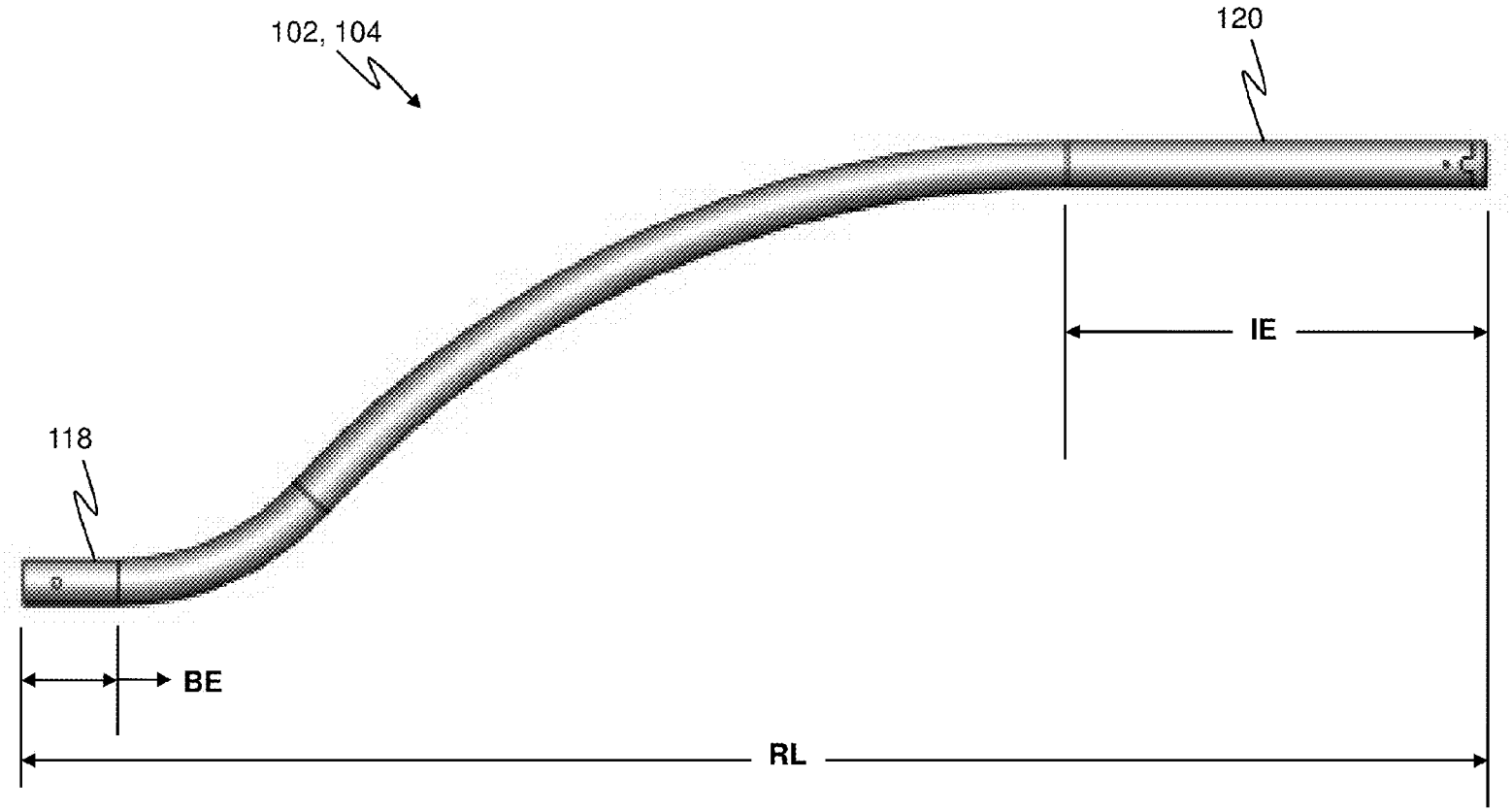
FIG. 13A is a side view of the first and second curved end piece, in accordance with one embodiment of the invention.
Figure 13B:
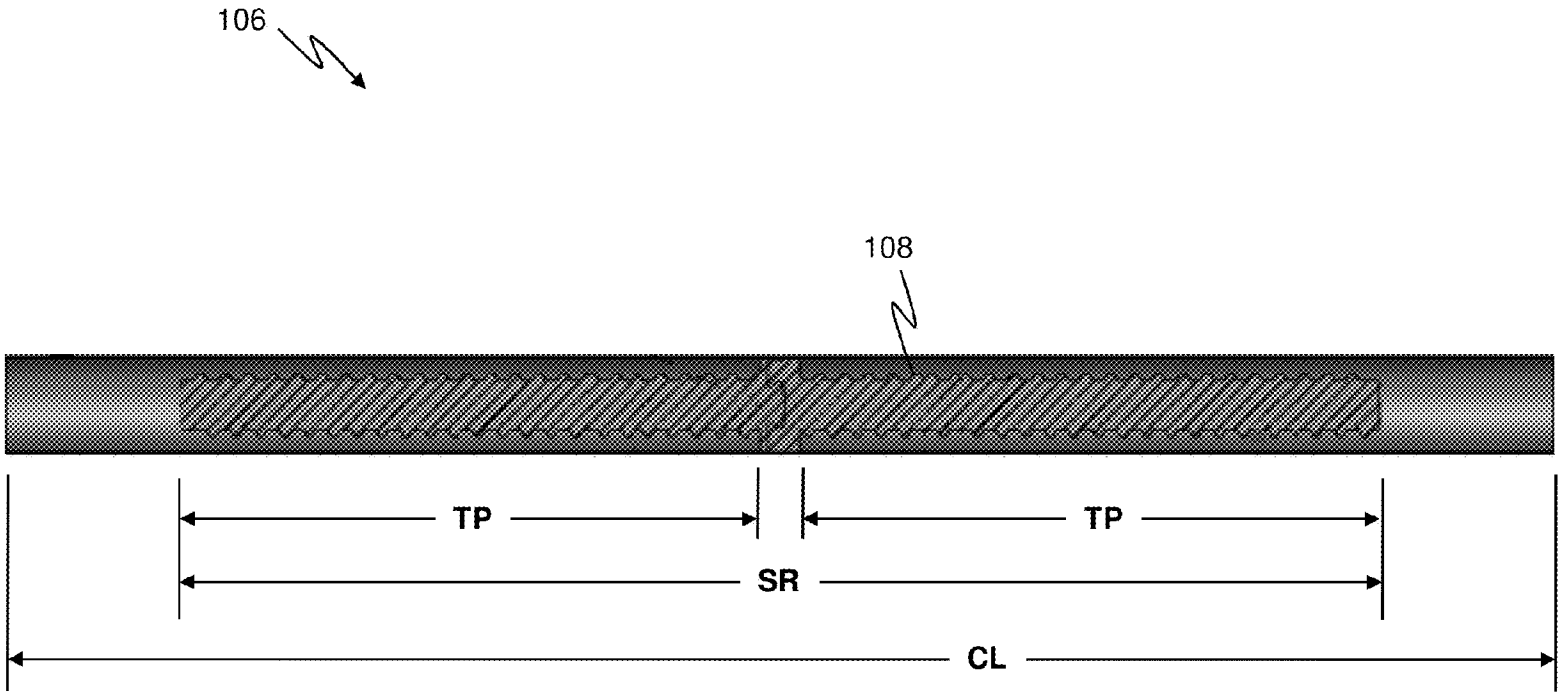
FIG. 13B a side sectional view of the center piece with the screw rod, in accordance with one embodiment of the invention.
Figure 13C:
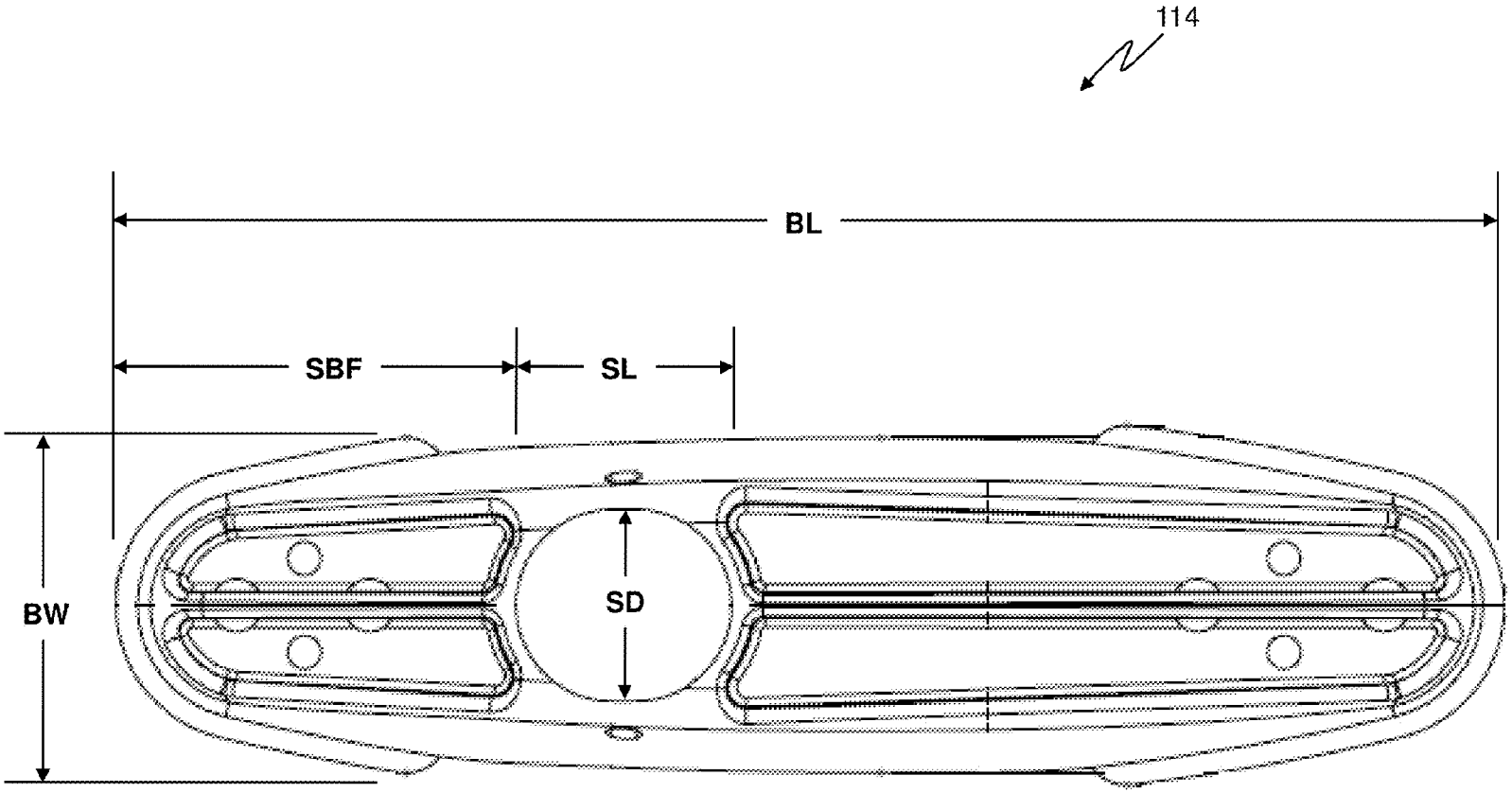
FIG. 13C is a top down view of the mounting bracket, in accordance with one embodiment of the invention.

In an additional embodiment, the shower rod 100 may include curved end pieces 102, 104 and a socket 146 that are keyed together to prevent rotation (for example, they may be square, triangle, hexagonal, etc. shaped) of the curved end pieces 102, 104 within the socket cavity 146. In this configuration, no mounting pin is needed and the rod is held in place by the structure defining the socket cavity 146. Additionally, in still yet another embodiment, fine adjustment screws 150 (or clips) may be provided to apply additional force to the first and second footpads 153, 155 and thus the shower wall 158 (See FIG. 12). It should be appreciated that the components of the shower rod 100 may be of any size suitable to the desired end purpose and thus may be of varying sizes that are suitable to varying shower enclosures. For example, referring to FIG. 13A, FIG. 13B and FIG. 13C, one embodiment of the curved shower rod assembly is shown where the first and second curved end pieces 102, 104 may have a length RL of about 27¾ inches (measured from bracket end 118 to interface end 120), where the bracket end 118 may have a length BE of about 2 inches and the interface end 120 may have a length IE of about 7¾ inches. Moreover, the center piece 106 may have a length CL of about 16 inches and the screw rod 108 may have a length SR of about 12½ inches, where the threaded portions of the screw rod 108 may have a length TP of about 6 inches. Furthermore, the mounting brackets 114 may have a bracket length BL of about 6½ inches and a bracket width BW of about 1½ inches, where the socket 146 may have a socket length SL of about 1 inch and a socket width SD of about 0.9 inches (or the socket 146 may be circular). Additionally, the socket 146 may located from bracket front by A distance SBF of about 1.4 inches.

While the invention has been described with reference to an exemplary embodiment, it should be understood by those skilled in the art that various changes may be made and equivalents may be substituted for elements thereof without departing from the scope of the invention. In addition, many modifications may be made to adapt a particular situation or material to the teachings of the invention without departing from the scope thereof. Therefore, it is intended that the invention not be limited to the particular embodiment disclosed as the best mode contemplated for carrying out this invention, but that the invention will include all embodiments falling within the scope of the specification/figures and any appended claims. Moreover, unless specifically stated any use of the terms first, second, etc. do not denote any order or importance, but rather the terms first, second, etc. are used to distinguish one element from another.

We claim:

1. A curved shower rod assembly, comprising:

a first end rod and a second end rod, wherein each of the first end rod and second end rod include a rod bracket end and a rod interface end, the rod bracket end and rod interface end being separated by a rod curved portion and wherein the rod interface end is hollow;

a center rod, wherein the center rod is hollow and includes a center rod inner diameter sized to movably contain the rod interface ends;

a screw rod having a first end with right-hand threads and a second end with left-hand threads, wherein the screw rod is securely contained within the center rod;

a first threaded sleeve and a second threaded sleeve, wherein the first and second threaded sleeve includes bi-directional internal threads, wherein the first threaded sleeve is located within the rod interface end of the first end rod and the second threaded sleeve is located within the rod interface end of the second end rod, and wherein the rod interface end of the first end rod is located within the center rod such that the first threaded sleeve is proximate the first end of the screw rod, and the rod interface end of the second end rod is located within the center rod such that the second threaded sleeve is proximate the second end of the screw rod; and a first mounting bracket and a second mounting bracket, wherein each of the first and second mounting brackets are oblong in shape and include a bracket front, a bracket rear, a bracket top and a bracket bottom, the bracket top defining a socket cavity configured to contain the rod bracket end of the first and second end rod, such that the first and second end rods are configured to be substantially perpendicular to the shower wall and wherein the socket cavity is offset from the center of the first and second mounting bracket to be located proximate the bracket front, and the bracket bottom including a plurality of footpads.

2. The curved shower rod assembly of claim 1, wherein the plurality of footpads include a first footpad and a second footpad, the first footpad being located proximate the bracket front and the second footpad being located proximate the bracket rear.

3. The curved shower rod assembly of claim 1, wherein the bracket top further defines a plurality of pin cavities communicated with the socket cavity and configured to be aligned with each other.

4. The curved shower rod assembly of claim 3, wherein the rod bracket end of the first and second end rods include a plurality of rod mounting holes aligned with each other to be located on opposing walls of the first and second end rods, wherein when the rod bracket end of the first and second end rods are located within the socket cavity, the plural of rod mounting holes are aligned with the plurality of pin cavities.

5. The curved shower rod assembly of claim 1, further comprising a first mounting pin and a second mounting pin, wherein the first mounting pin is associated with the first mounting bracket and first end rod to be located within the plurality of mounting holes and plurality of pin cavities and wherein the second mounting pin is associated with the second mounting bracket and second end rod to be located within the plurality of mounting holes and plurality of pin cavities.

6. The curved shower rod assembly of claim 1, wherein the bracket end and rod interface end of the first and second end rods are substantially straight.

7. The curved shower rod assembly of claim 1, wherein the screw rod includes a screw rod center portion that separates the first end from the second end, and wherein the screw rod center portion is sized to frictionally interact with the center rod when located within the center rod.

8. The curved shower rod assembly of claim 1, further comprising a plurality of ferrules, wherein the plurality of ferrules are configured to frictionally contain the center rod and located to cover the joint formed between the center rod and the bracket interface end of the first and second end rods.

9. A curved shower rod, comprising:

a first end rod and a second end rod, wherein each of the first end rod and second end rod include a rod bracket end and a rod interface end, the rod bracket end and rod interface end being separated by a rod curved portion and wherein the rod interface end is hollow;

a center rod, wherein the center rod is hollow and includes a center rod inner diameter sized to movably contain the rod interface ends;

a screw rod having a first end with right-hand threads and a second end with left-hand threads, wherein the screw rod is securely contained within the center rod;

a first threaded sleeve and a second threaded sleeve, the first and second threaded sleeves having bi-directional internal threads, wherein the first threaded sleeve is located within the rod interface end of the first end rod and the second threaded sleeve is located within the rod interface end of the second end rod, and wherein the rod interface end of the first end rod is located within the center rod such that the first threaded sleeve and the first end of the screw rod are threadingly associated and the rod interface end of the second end rod is located within the center rod such that the second threaded sleeve and the second end of the screw rod are threadingly associated.

10. The curved shower rod of claim 9, wherein the screw rod includes a screw rod center portion that separates the first end from the second end, and wherein the screw rod center portion is sized to frictionally interact with the center rod when located within the center rod.

11. The curved shower rod of claim 9, wherein the bracket end and rod interface end of the first and second end rods are substantially straight.

12. The curved shower rod of claim 9, wherein the first threaded sleeve and second threaded sleeve are frictionally contained within the bracket end of the first and second end rods.

13. The curved shower rod of claim 8, wherein the bracket end of the first and second end rods are configured to mate with a socket cavity of a mounting bracket, wherein the mounting bracket is oblong in shape and includes a bracket front, a bracket rear, a bracket top and a bracket bottom, wherein the bracket top defines a socket cavity and the bracket bottom includes a first footpad and a second footpad, wherein the socket cavity is located proximate the bracket front and wherein the first footpad is located proximate the bracket front and the second footpad is located proximate the bracket rear.

14. A mounting bracket for mounting a curved shower rod within a shower enclosure between a pair of shower walls, wherein the curved shower rod includes a screw rod having a first end with right-hand threads and a second end with left-hand threads, wherein the screw rod is securely contained within the curved shower rod, the curved shower rod mounting bracket comprising:

a first mounting bracket, and a second mounting bracket, wherein each of the first mounting bracket and second mounting bracket are oblong in shape and includes a bracket front, a bracket rear, a bracket top and a bracket bottom, the bracket top defining a socket cavity and the bracket bottom including a first footpad and a second footpad, the socket cavity being located proximate the bracket front and configured to contain the rod bracket end of a first end rod of a curved shower rod and a second end rod of a curved shower rod, such that the first and second end rods are configured to be substantially perpendicular to the shower walls, and the first footpad being located proximate the bracket front and the second footpad being located proximate the bracket rear.

15. The curved shower rod mounting bracket of claim 14, wherein the first footpad is larger than the second footpad.

16. The curved shower rod mounting bracket of claim 14, wherein the bracket top defines a plurality of pin cavities communicated with the socket cavity and aligned with each other.

17. The curved shower rod mounting bracket of claim 16, wherein the rod bracket end of the first and second end rods include a plurality of rod mounting holes located on opposing walls of the first and second end rods and aligned with each other, wherein when the rod bracket end of the first and second end rods are located within the socket cavity, the plural of rod mounting holes are aligned with the plurality of pin cavities.

18. The curved shower rod mounting bracket of claim 14, further comprising a plurality of mounting bracket screw holes configured to communicate the bracket top with the bracket bottom.

19. The curved shower rod mounting bracket of claim 14, further comprising a bracket cover, wherein the bracket cover is configured to engage the mounting bracket to securely cover the mounting bracket, wherein the bracket cover defines a trim cover pin opening located such that when bracket cover is associated with the mounting bracket, the trim cover pin opening is aligned with the mounting pin opening.

* * * * *